US007231054B1

(12) United States Patent
Jot et al.

(10) Patent No.: US 7,231,054 B1
(45) Date of Patent: Jun. 12, 2007

(54) METHOD AND APPARATUS FOR THREE-DIMENSIONAL AUDIO DISPLAY

(75) Inventors: Jean-Marc Jot, Aptos, CA (US); Scott Wardle, Santa Cruz, CA (US)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 09/806,193

(22) PCT Filed: Sep. 24, 1999

(86) PCT No.: PCT/US99/22259

§ 371 (c)(1),
(2), (4) Date: Jan. 9, 2002

(87) PCT Pub. No.: WO00/19415

PCT Pub. Date: Apr. 6, 2000

(51) Int. Cl.
*H04R 5/02* (2006.01)

(52) U.S. Cl. ..... 381/310; 381/18; 381/22; 381/23

(58) Field of Classification Search ..... 381/309, 381/17, 23, 18, 22, 310
See application file for complete search history.

(56) References Cited

U.S. PATENT DOCUMENTS

| | | | | |
|---|---|---|---|---|
| 4,086,433 | A * | 4/1978 | Gerzon | 381/21 |
| 5,436,975 | A | 7/1995 | Lowe et al. | |
| 5,500,900 | A | 3/1996 | Chen et al. | |
| 5,521,981 | A | 5/1996 | Gehring | |
| 5,596,644 | A * | 1/1997 | Abel et al. | 381/17 |
| 5,757,927 | A * | 5/1998 | Gerzon et al. | 381/20 |
| 5,802,180 | A | 9/1998 | Abel et al. | |
| 5,809,149 | A | 9/1998 | Cashion et al. | |
| 6,259,795 | B1 * | 7/2001 | McGrath | 381/310 |
| 6,418,226 | B2 * | 7/2002 | Mukojima | 381/17 |
| 6,577,736 | B1 * | 6/2003 | Clemow | 381/18 |
| 6,628,787 | B1 * | 9/2003 | McGrath et al. | 381/18 |
| 6,990,205 | B1 * | 1/2006 | Chen | 381/17 |

OTHER PUBLICATIONS

Jeffrey S. Bamford, et al., Ambisonic Sound for Us, Presented at the 99th Conv. Audio Eng. Soc. (preprint 4138).

(Continued)

*Primary Examiner*—Vivian Chin
*Assistant Examiner*—Jason Kurr
(74) *Attorney, Agent, or Firm*—Schwegman, Lundberg, Woessner, & Kluth, P.A.

(57) ABSTRACT

This invention addresses sound recording and mixing methods for 3-D audio rendering of multiple sound sources over headphones or loudspeaker playback systems. Economical techniques are provided, whereby directional panning and mixing of sounds are performed in a multi-channel encoding format which preserves interaural time difference information and does not contain head-related spectral information. Decoders are provided for converting the multi-channel encoded signal into signals for playback over headphones or various loudspeaker arrangements. These decoders ensure faithful reproduction of directional auditory information at the eardrums of the listener and can be adapted to the number and geometrical layout of the loudspeakers and the individual characteristics of the listener. A particular multi-channel encoding format is disclosed, which, in addition to the above advantages, is associated with a practical microphone technique for producing 3-D audio recordings compliant with the decoders described.

28 Claims, 13 Drawing Sheets

OTHER PUBLICATIONS

John M. Chowning, The Simulation of Moving Sound Sources, J. Audio Eng. Soc. Jan. 1971, vol. 19, No. 1, pp. 2-6.

Michael J. Evans, et al., Spherical Harmonic Spectra of Head-Related Transfer Functions, Presented at the 103rd Conv. Audio Eng. Soc. (preprint 4571), Sept. 1997, New York.

Ken Farrar, Soundfield Microphone, Wireless World, Oct. 1979, pp. 48-50.

Ken Farrar, Soundfield Microphone—2, Wireless World, Nov. 1979, pp. 99-102.

Michael A. Gerzon, Ambisonics in Multichannel Broadcasting and Video, J. Audio Eng. Soc., vol. 33, No. 11, Nov. 1985, pp. 859-871.

Jean-Marc Jot, et al., A Comparative Study of 3-D Audio Encoding and Rendering Techniques, AES 16th Intl. Conf. on Spatial Sound Reproduction.

Jean-Marc Jot, et al., Digital Signal Processing Issues in the Context of Binaural and Transaural Stereophony, Presented at the 98th Conv. Audio Eng. Soc. (preprint 3980), Feb. 1995, Paris, France.

Doris J. Kistler, et al., A Model of Head-Related Transfer Functions Based on Principal Components Analysis and Minimum-Phase Reconstruction, J. Acoust. Soc. Am. vol. 91, No. 3, Mar. 1992, pp. 1637-1647.

M. Marolt, Proc. IEEE 1995 Workshop on Applications of Signal Processing to Audio and Acoustics, Oct. 15-18, New York.

Ville Pulkki, Virtual Sound Source Positioning Using Vector Base Amplitude Panning, J. Audio Eng. Soc., vol. 45, No. 6, Jun. 1997, pp. 456-466.

William L. Martens, Principal Components Analysis and Resynthesis of Spectral Cues to Perceived Direction, 1987 ICMC Proceedings, Aug. 1987, Illinois, pp. 274-281.

Chris Travis, Virtual Reality Perspective on Headphone Audio, Presented at 101st Conv. Audio Eng. Soc. (preprint 4354).

William G. Gardner, 3-D Audio Using Loudspeakers Submitted to the Program in Media Arts and Sciences, Sep. 1997.

* cited by examiner 4-channel Binaural B Format louspeaker decoder

METHOD AND APPARATUS FOR THREE-DIMENSIONAL AUDIO DISPLAY

FIELD OF THE INVENTION

The present invention relates generally to audio recording, and more specifically to the mixing, recording and playback of audio signals for reproducing real or virtual three-dimensional sound scenes at the eardrums of a listener using loudspeakers or headphones.

BACKGROUND

A well-known technique for artificially positioning a sound in a multi-channel loudspeaker playback system consists of weighting an audio signal by a set of amplifiers feeding each loudspeaker individually. This method, described e.g. in [Chowning71], is often referred to as "discrete amplitude panning" when only the loudspeakers closest to the target direction are assigned non-zero weights, as illustrated by the graph of panning functions in FIG. 1. Although FIG. 1 shows a two-dimensional loudspeaker layout, the method can be extended with no difficulty to three-dimensional loudspeaker layouts, as described e.g. in [Pulkki97]. A drawback of this technique is that it requires a high number of channels to provide a faithful reproduction of all directions. Another drawback is that the geometrical layout of the loudspeakers must be known at the encoding and mixing stage. An alternative approach, described in [Gerzon85], consists of producing a 'B-Format' multi-channel signal and reproducing this signal over loudspeakers via an 'Ambisonic' decoder, as illustrated in FIG. 2. Instead of discrete panning functions, the B Format uses real-valued spherical harmonics. The zero-order spherical harmonic function is named W, while the three first-order harmonics are denoted X, Y, and Z. These functions are defined as follows:

$$W(\sigma,\phi)=1$$

$$X(\sigma,\phi)=\cos(\phi)\cos(\sigma)$$

$$Y(\sigma,\phi)=\cos(\phi)\sin(\sigma)$$

$$Z(\sigma,\phi)=\sin(\phi)$$

where $\sigma$ and $\phi$ denote respectively the azimuth and elevation angles of the sound source with respect to the listener, expressed in radians. An advantage of this technique over the discrete panning method is that B Format encoding does not require knowledge of the loudspeaker layout, which is taken into account in the design of the decoder. A second advantage is that a real-world B-Format recording can be produced with practical microphone technology, known as the 'Soundfield Microphone' [Farrah79]. As illustrated in FIG. 2, this allows for combining microphone-encoded sounds with electronically encoded sounds to produce a single B-format recording. First-order Ambisonic decoders do not reconstruct the acoustic pressure information at the ears of the listener except at low frequencies (below about 700 Hz). As described e.g. in [Bamford95], the frequency range can be extended by increasing the order of spherical harmonics, but only at the expense of a higher number of encoding channels and loudspeakers.

3-D audio reproduction techniques which specifically aim at reproducing the acoustic pressure at the two ears of a listener are usually termed binaural techniques. This approach is illustrated in FIG. 3 and reviewed e.g. in [Jot95]. A binaural recording can be produced by inserting miniature microphones in the ear canals of an individual or dummy head. Binaural encoding of an audio signal (also called binaural synthesis) can be performed by applying to a sound signal a pair of left and right filters modeling the head-related transfer functions (HRTFs) measured on an individual or a dummy head for a given direction. As shown in FIG. 3, a HRTF can be modeled as a cascaded combination of a delaying element and a minimum-phase filter, for each of the left and right channels. A binaurally encoded or recorded signal is suitable for playback over headphones. For playback over loudspeakers, a cross-talk canceller is used, as described e.g. in [Gardner97].

Conventional binaural techniques can provide a more convincing 3-D audio reproduction, over headphones or loudspeakers, than the previously described techniques. However, they are not without their own drawbacks and difficulties.

- Compared to discrete amplitude panning or B-Format encoding, binaural synthesis involves a significantly larger amount of computation for each sound source. An accurate finite impulse response (FIR) model of an HRTF typically requires a 1-ms long response, i.e. approximately 100 additions and multiplies per sample period at a sample rate of 48 kHz, which amounts to 5 MIPS (million instructions per second).
- The HRTF can only be measured at a set of discrete positions around the head. Designing a binaural synthesis system which can faithfully reproduce any direction and smooth dynamic movements of sounds is a challenging problem involving interpolation techniques and time-variant filters, implying an additional computational effort.
- The binaurally recorded or encoded signal contains features related to the morphology of the torso, head, and pinnae. Therefore the fidelity of the reproduction is compromised if the listener's head is not identical to the head used in the recording or the HRTF measurements. In headphone playback, this can cause artifacts such as an artificial elevation of the sound, front-back confusions or inside-the-head localization.
- In reproduction over two loudspeakers, the listener must be located at a specific position for lateral sound locations to be convincingly reproduced (beyond the azimuth of the loudspeakers), while rear or elevated sound locations cannot be reproduced reliably.

[Travis96] describes a method for reducing the computational cost of the binaural synthesis and addresses the interpolation and dynamic issues. This method consists of combining a panning technique designed for N-channel loudspeaker playback and a set of N static binaural synthesis filter pairs to simulate N fixed directions (or "virtual loudspeakers") for playback over headphones. This technique leads to the topology of FIG. 4*a*, where a bank of binaural synthesis filters is applied after panning and mixing of the source signals. An alternative approach, described in [Gehring96], consists of applying the binaural synthesis filters before panning and mixing, as illustrated in FIG. 4*b*. The filtered signals can be produced off-line and stored so that only the panning and mixing computations need to be performed in real time. In terms of reproduction fidelity, these two approaches are equivalent. Both suffer from the inherent limitations of the multi-channel positioning techniques. Namely, they require a large number of encoding channels to faithfully reproduce the localization and timbre of sound signals in any direction.

[Lowe95] describes a variation of the topology of FIG. 4*a*, in which the directional encoder generates a set of two-channel (left and right) audio signals, with a direction-dependent time delay introduced between the left and right channels, and each two-channel signal is panned between front, back and side "azimuth placement" filters. [Chen96] uses an analysis method known as principal component analysis (PCA) to model any set of HRTFs as a weighted sum of frequency-dependent functions weighted by functions of direction. The two sets of functions are listener-specific (uniquely associated to the head on which the HRTF were measured) and can be used to model the left filter and the right filter applied to the source signal in the directional encoder. [Abel97] also shows the topologies of FIGS. 4*a* and 4*b* and uses a singular value decomposition (SVD) technique to model a set of HRTFs in a manner essentially equivalent to the method described in [Chen96], resulting in the simultaneous solution for a set of filters and the directional panning functions.

There remains a need for a computationally efficient technique for high-fidelity 3-D audio encoding and mixing of multiple audio signals. It is desirable to provide an encoding technique that produces a non listener-specific format. There is a need for a practical recording technique and suitably designed decoders to provide faithful reproduction of the pressure signals at the ears of a listener over headphones or two-channel and multi-channel loudspeaker playback systems.

SUMMARY OF THE INVENTION

A method for positioning an audio signal includes selecting a set of spatial functions and providing a set of amplifiers. The gains of the amplifiers being dependent on scaling factors associated with the spatial functions. An audio signal is received and a direction for the audio signal is determined. The scaling factors are adjusted depending on the direction. The amplifiers are applied to the audio signal to produce first encoded signals. The audio signal is then delayed. The second filters are then applied to the delayed signal to produce second encoded signals. The resulting encoded signals contain directional information. In one embodiment of the invention, the spatial functions are the spherical harmonic functions. The spherical harmonics may include zero-order and first-order harmonics and higher order harmonics. In another embodiment, the spatial functions include discrete panning functions.

Further in accordance with the method of the invention, a decoding of the directionally encoded audio includes providing a set of filters. The filters are defined based on the selected spatial functions.

An audio recording apparatus includes first and second multiplier circuits having adjustable gains. A source of an audio signal is provided, the audio signal having a time-varying direction associated therewith. The gains are adjusted based on the direction for the audio. A delay element inserts a delay into the audio signal. The audio and delayed audio are processed by the multiplier circuits, thereby creating directionally encoded signals. In one embodiment, an audio recording system comprises a pair of soundfield microphones for recording an audio source. The soundfield microphones are spaced apart at the positions of the ears of a notional listener.

According to the invention, a method for decoding includes deriving a set of spectral functions from preselected spatial functions. The resulting spectral functions are the basis for digital filters which comprise the decoder.

According to the invention, a decoder is provided comprising digital filters. The filters are defined based on the spatial functions selected for the encoding of the audio signal. The filters are arranged to produce output signals suitable for feeding into loudspeakers.

The present invention provides an efficient method for 3-D audio encoding and playback of multiple sound sources based on the linear decomposition of HRTF using spatial panning functions and spectral functions, which

- guarantees accurate reproduction of ITD cues for all sources over the whole frequency range
- uses predetermined panning functions.

The use of predetermined panning functions offers the following advantages over methods of the prior art which use principal components analysis or singular value decomposition to determine panning functions and spectral functions:

- efficient implementation in hardware or software
- non-individual encoding/recording format
- adaptation of the decoder to the listener
- improved multi-channel loudspeaker playback Two particularly advantageous choices for the panning functions are detailed, offering additional benefits:

Spherical harmonics

- allow to make recordings using available microphone technology (a pair of Soundfield microphones)
- yield a recording format that is a superset of the B format standard
- associated to a special decoding technique for multi-channel loudspeaker playback Discrete panning functions

- guarantees exact reproduction of chosen directions
- increased efficiency of implementation (by minimizing the number of non-zero panning weights for each source)
- associated to a special decoding technique for multi-channel loudspeaker playback

DETAILED DESCRIPTION OF THE PREFERRED EMBODIMENTS

Modeling HRTF Using Predetermined Spatial Functions

Figure 1:
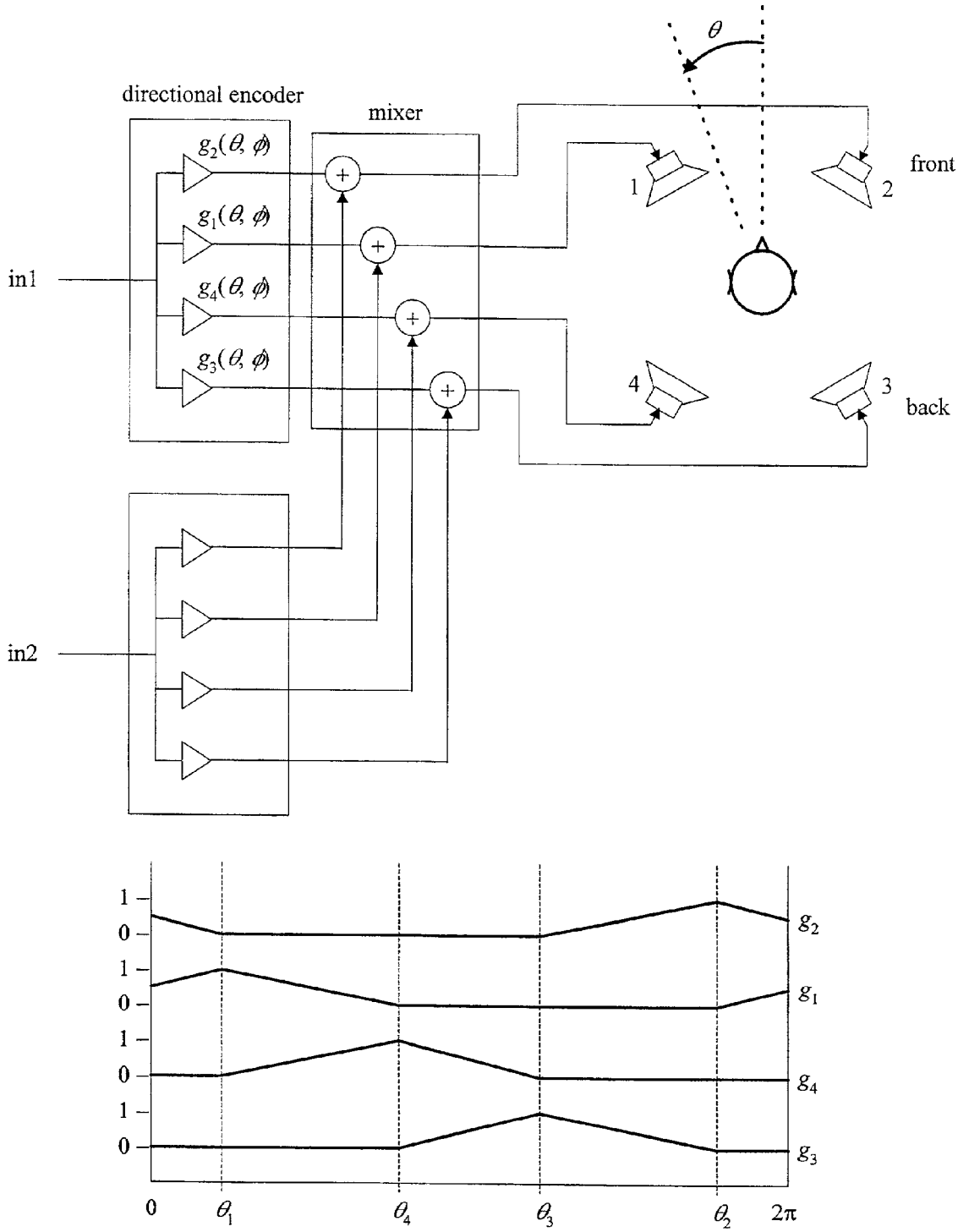
FIG. 1: Discrete panning over 4 loudspeakers. Example of discrete panning functions.

Given a set of N spatial panning functions $\{g_i(\sigma, \phi), i=0, 1, \ldots N-1\}$ the procedure for modeling HRTF according to the present invention is as follows. This procedure is associated to the topologies described in FIG. 5*a* and FIG. 5*b* for directionally encoding one or several audio signals and decoding them for playback over headphones.

1. Measuring HRTFs for a set of positions $\{(\sigma_p, \phi_p), p=1, 2, \ldots P\}$. The sets of left-ear and right-ear HRTFs will be denoted, respectively, as:

$$\{L(\sigma_p,\phi_p,f)\} \text{ and } \{R(\sigma_p,\phi_p,f)\}, \text{ for } p=1, 2, \ldots P,$$

where f denotes frequency.

2. Extracting the left and right delays $t_L(\sigma_p, \phi_p)$ and $t_R(\sigma_p, \phi_p)$ for every position. Denoting $T(\sigma, \phi, f)=\exp(2\pi j\, f\, t(\sigma, \phi))$, the time-delay operator of duration t, expressed in the frequency domain, the left-ear and right-ear HRTFs are expressed by:

$$L(\sigma_p,\phi_p,f)=T_L(\sigma_p,\phi_p,f)\underline{L}(\sigma_p,\phi_p,f),$$

$$R(\sigma_p,\phi_p,f)=T_R(\sigma_p,\phi_p,f)\underline{R}(\sigma_p,\phi_p,f), \text{ for } p=1, 2, \ldots P.$$

3. Equalization removing a common transfer function from all HRTFs measured on one ear. This transfer function can include the effect of the measuring apparatus, loudspeaker, and microphones used. It can also be the delay-free HRTF $\underline{L}$ (or $\underline{R}$) measured for one particular direction (free-field equalization), or a transfer function representing an average of all the delay-free HRTFs $\underline{L}$ (or $\underline{R}$) measured over all positions (diffuse-field equalization).
4. Symmetrization, whereby the HRTFs and the delays are corrected in order to verify the natural left-right symmetry relations:

$$\underline{R}(\sigma,\phi,f)=\underline{L}(2\pi-\sigma,\phi,f) \text{ and } t_L(\sigma,\phi)=t_R(2\pi-\sigma,\phi).$$

5. Derivation of the set of reconstruction filters $\{L_i(f)\}$ and $\{R_i(f)\}$ satisfying the approximate equations:

$$\underline{L}(\sigma_p,\phi_p,f)\approx\Sigma_{\{i=0,\ldots N-1\}}g_i(\sigma_p,\phi_p)L_i(f),$$

$$\underline{R}(\sigma_p,\phi_p,f)\approx\Sigma_{\{i=0,\ldots N-1\}}g_i(\sigma_p,\phi_p)R_i(f), \text{ for } p=1, 2, \ldots P.$$

In practice, the measured HRTFs are obtained in the digital domain. Each HRTF is represented as a complex frequency response sampled at a given number of frequencies over a limited frequency range, or, equivalently, as a temporal impulse response sampled at a given sample rate. The HRTF set $\{\underline{L}(\sigma_p, \phi_p, f)\}$ or $\{\underline{R}(\sigma_p, \phi_p, f)\}$ is represented, in the above decomposition, as a complex function of frequency in which every sample is a function of the spatial variables $\sigma$ and $\phi$, and this function is represented as a weighted combination of the spatial functions $g_i(\sigma, \phi)$. As a result, a sampled complex function of frequency is associated to each spatial function $g_i(\sigma, \phi)$, which defines the sampled frequency response of the corresponding filter $L_1(f)$ or $R_i(f)$. It is noted that, due to the linearity of the Fourier transform, an equivalent decomposition would be obtained if the frequency variable f were replaced by the time variable in order to reconstruct the time-domain representation of the HRTF.

The equalization and the symmetrization of the HRTF sets $\underline{L}(\sigma_p, \phi_p, f)$ and $\underline{R}(\sigma_p, \phi_p, f)$, are not necessary to carrying out the invention. However, performing these operations eliminates some of the artifacts associated to the HRTF measurement method. Thus, it may be preferable to perform these operations for their practical advantages.

Figure 4A:
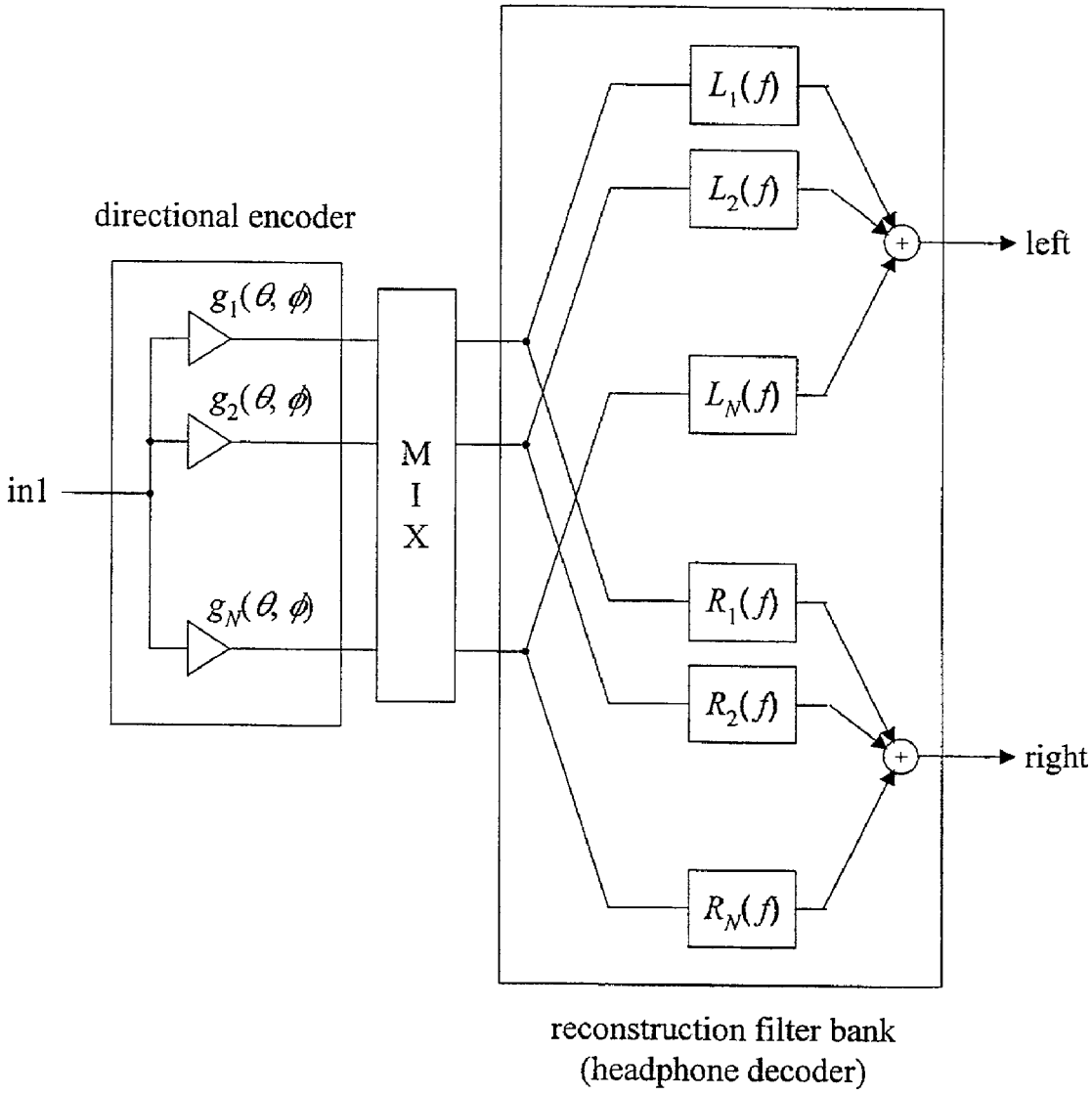
FIG. 4: (a) Post-filtering topology. (b) Pre-filtering topology.
Figure 4B:
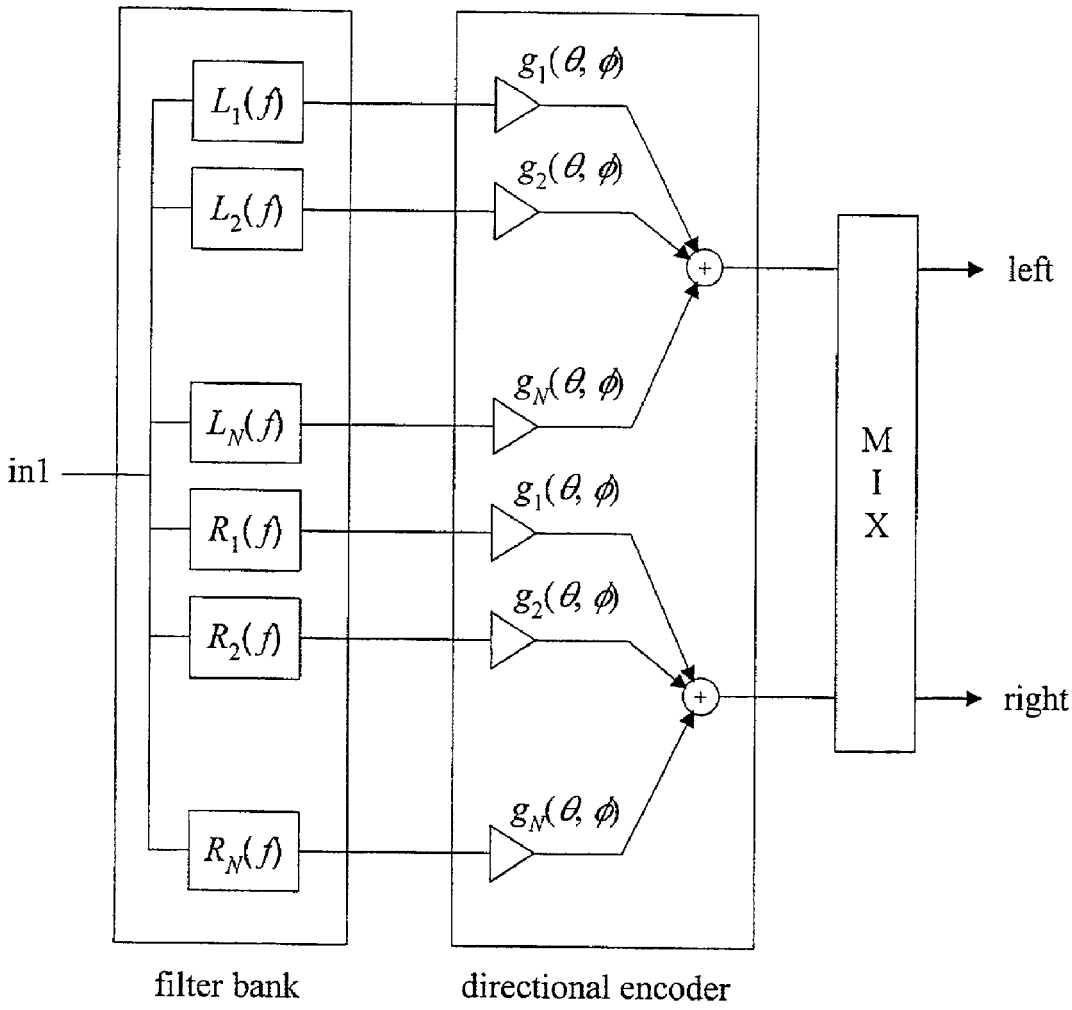
Figure 5A:
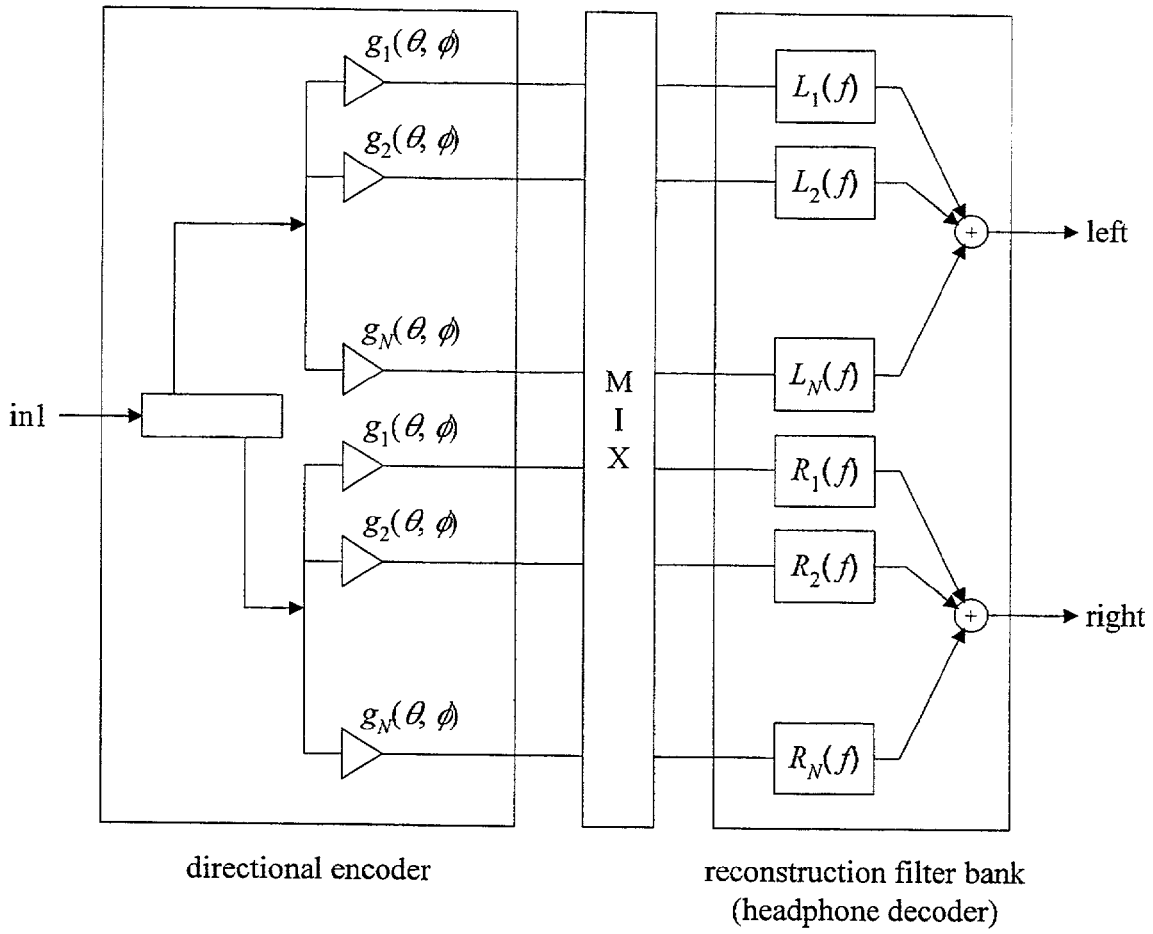
FIG. 5: (a) Post-filtering and (b) pre-filtering topologies, with control of interaural time difference for each sound source.
Figure 5B:
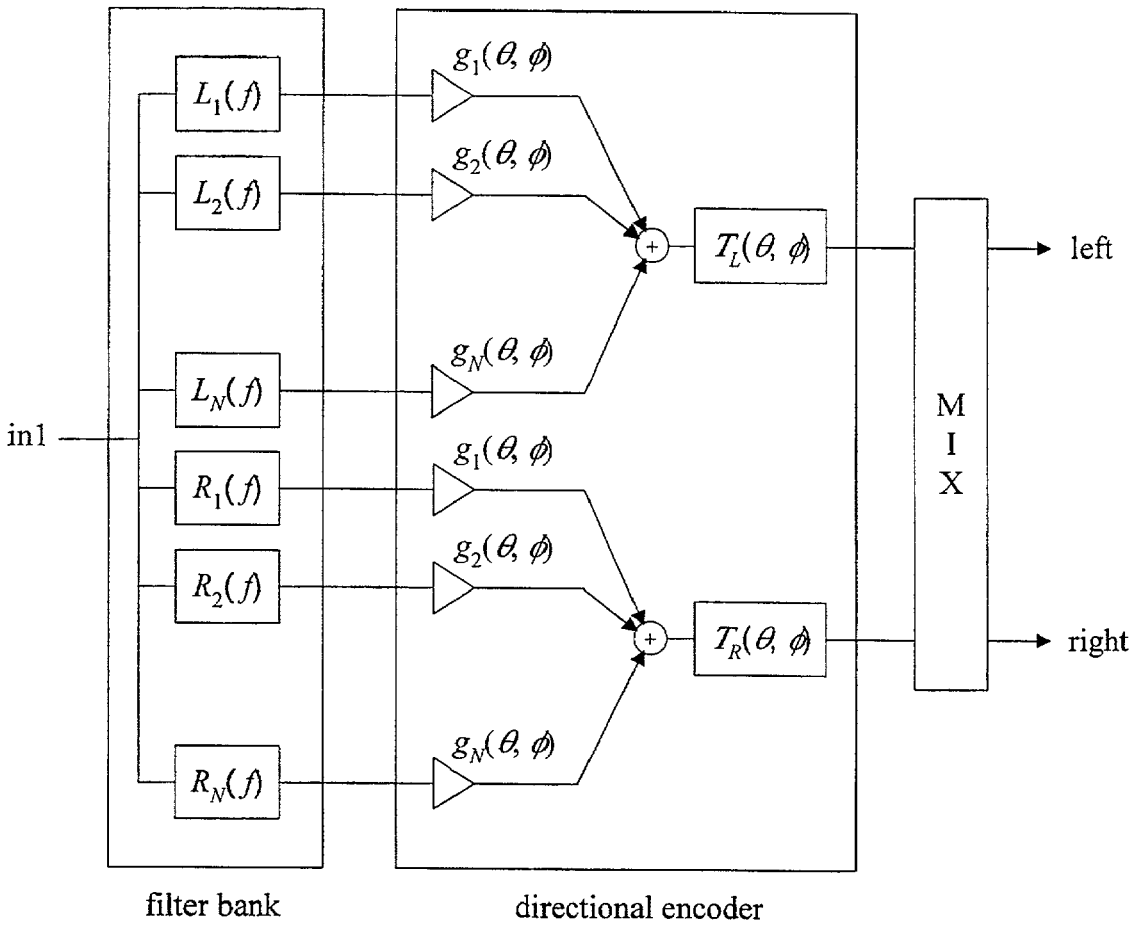

Step 2 is optional and is associated to the binaural synthesis topologies described in FIGS. 5*a* and 5*b*, where the delays $t_L(\sigma, \phi)$ and $t_R(\sigma, \phi)$ are introduced in the directional encoding module for each sound source. If step 2 is not applied, the binaural synthesis topologies of FIGS. 4*a* and 4*b* can be used. If the delay extraction procedure is appropriately performed (as discussed below) the topologies of FIGS. 5*a* and 5*b* will provide a higher fidelity with fewer encoding channels. It will be noted that adding or subtracting a common delay offset to $t_L(\sigma, \phi)$ and $t_R(\sigma, \phi)$ in the encoding module will have no effect over the perceived direction of sounds during playback, even if the delay offset varies with direction, as long as the interaural time delay difference (ITD), defined below, is preserved for each direction.

$$ITD(\sigma,\phi)=t_R(\sigma,\phi)-t_L(\sigma,\phi).$$

It is noted that the above procedure differs from the methods of the prior art. Conventional analytical techniques, such as PCA and SVD, simultaneously produce the spectral functions and the spatial functions which minimize the least-squares error between the original HRTFs and the reconstructed HRTFs for a given number of channels N. In the elaboration of the present invention, it is recognized in particular, that these earlier methods suffer from the following drawbacks:

The spatial panning functions cannot be chosen a priori.

The choice of error criterion to be minimized (mean squared error) enables the resolution of the approximation problem via tractable linear algebra. However, the technique does not guarantee that the model of the HRTF thus obtained is optimal in terms of perceived reproduction for a given number of encoding channels.

In comparison, the technique in accordance with the present invention permits a priori selection of the spatial functions, from which the spectral functions are derived. As will be apparent from the following description, several benefits of the present invention will result from the possibility of choosing the panning functions a priori and from using a variety of techniques to derive the associated reconstruction filters.

An immediate advantage of the invention is that the encoding format in which sounds are mixed in FIG. 5*a* is devoid of listener specific features. As discussed below, it is possible, without causing major degradations in reproduction fidelity, to use a listener-independent model of the ITD in carrying out the invention.

Generally, it is possible to make a selection of spatial panning functions and tune the reconstruction filters to achieve practical advantages such as:

enabling improved reproduction over multi-channel loudspeaker systems, enabling the production of microphone recordings, preserving a high fidelity of reproduction in chosen directions or regions of space even with a low number of channels.

Two particular choices of spatial panning functions will be detailed in this description: spherical harmonic functions and discrete panning functions. Practical methods for designing the set of reconstruction filters $L_i(f)$ and $R_i(f)$ will be described in more detail. From the discussion which follows, it will be clear to a person of ordinary skill in the relevant art that other spatial functions can be used and that alternative techniques for producing the corresponding reconstruction filters are available.

Delay Extraction Techniques

The extraction of the interaural time delay difference, $ITD(\sigma_p, \phi_p)$, from the HRTF pair $L(\sigma_p, \phi_p, f)$ and $R(\sigma_p, \phi_p, f)$ is performed as follows.

Any transfer function H(f) can be uniquely decomposed into its all-pass component and its minimum-phase component as follows:

$$H(f)=\exp(j\phi(f))H_{min}(f)$$

where $\phi(f)$, called the excess-phase function of H(f), is defined by $$\phi(f)=Arg(H(f))-Re(\text{Hilbert}(-\text{Log}|H(f)|)).$$

Applying this decomposition to the HRTFs $L(\sigma_p, \phi_p, f)$ and $R(\sigma_p, \phi_p, f)$, we obtain the corresponding excess-phase functions, $\phi_R(\sigma_p, \phi_p, f)$ and $\phi_L(\sigma_p, \phi_p, f)$, and the corresponding minimum-phase HRTFs, $L_{min}(\sigma_p, \phi_p, f)$ and $R_{min}(\sigma_p, \phi_p, f)$. The interaural time delay difference, $ITD(\sigma_p, \phi_p)$, can be defined, for each direction $(\sigma_p, \phi_p)$, by a linear approximation of the interaural excess-phase difference:

$$\phi_R(\sigma,\phi,f)-\phi_L(\sigma,\phi,f)\approx 2\pi f ITD(\sigma,\phi).$$

In practice, this approximation may be replaced by various alternative methods of estimating the ITD, including time-domain methods such as methods using the cross-correlation function of the left and right HRTFs or methods using a threshold detection technique to estimate an arrival time at each ear. Another possibility is to use a formula for modeling the variation of ITD vs. direction. For instance, the spherical head model with diametrically opposite ears yields $$ITD(\sigma,\phi)=r/c[\ \arcsin(\cos(\phi)\sin(\sigma))+\cos(\phi)\sin(\sigma)],$$

the free-field model—where the ears are represented by two points separated by the distance 2r–yields $$ITD(\sigma,\phi)\ 2r/c\ \cos(\phi)\sin(\sigma),$$

where c denotes the speed of sound. In these two formulas, the value of the radius r can be chosen so that $ITD(\sigma_p, \phi_p)$ is as large as possible without exceeding the value derived from the linear approximation of the interaural excess-phase difference. In a digital implementation, the value of $ITD(\sigma_p, \phi_p)$, can be rounded to the closest integer number of samples, or the interaural excess-phase difference may be approximated by the combination of a delay unit and a digital all-pass filter.

The delay-free HRTFs, $\underline{L}(\sigma_p, \phi_p, f)$ and $\underline{R}(\sigma_p, \phi_p, f)$, from which the reconstruction filters $L_i(f)$ and $R_i(f)$ will be derived, can be identical, respectively, to the minimum-phase HRTF $L_{min}(\sigma_p, \phi_p, f)$ and $R_{min}(\sigma_p, \phi_p, f)$.

Whatever the method used to extract or model the interaural time delay difference from the measured HRTF, it can be regarded as an approximation of the interaural excess-phase difference $\phi_R(\sigma, \phi, f)-\phi_L(\sigma, \phi, f)$ by a model function $\phi(\sigma, \phi, f)$:

$$\phi_R(\sigma,\phi,f)-\phi_L(\sigma,\phi,f)\approx\phi(\sigma,\phi,f).$$

It may be advantageous, in order to improve the fidelity of the 3-D audio reproduction according to the present invention, to correct for the error made in this phase difference approximation, by incorporating the residual excess-phase difference into the delay-free HRTFs $\underline{L}(\sigma_p, \phi_p, f)$ and $\underline{R}(\sigma_p, \phi_p, f)$ as follows:

$$\underline{L}(f)=L_{min}(f)\exp(j\phi_L(f)) \text{ and } \underline{R}(f)=R_{min}(f)\exp(j\phi_R(f)),$$

where $\phi_L(f)$ and $\phi_R(f)$ satisfy $$\phi_R(f)-\phi_L(f)=\phi_R(f)-\phi_L(f)-\phi(\sigma,\phi,f),$$

and either $\phi_L(f)=0$ or $\phi_R(f)=0$, as appropriate to ensure that the delay-free HRTFs $\underline{L}(\sigma_p, \sigma_p, f)$ and $\underline{R}(\sigma_p, \sigma_p, f)$ are causal transfer functions.

Application of Spherical Harmonic Functions for Encoding and Recording

General Definition of Spherical Harmonics.

Of particular interest in the following description are the zero-order harmonic W and the first-order harmonics X, Y and Z defined earlier, as well as the second-order harmonics, U and V, and the third-order harmonics, S and T, defined below.

$$U(\sigma,\phi)=\cos^2(\phi)\cos(2\sigma)$$

$$V(\sigma,\phi)=\cos^2(\phi)\sin(2\sigma)$$

$$S(\sigma,\phi)=\cos^3(\phi)\cos(3\sigma)$$

$$T(\sigma,\phi)=\cos^3(\phi)\sin(3\sigma)$$

Advantages of spherical harmonics include:

mathematically tractable, closed form → interpolation between directions mutually orthogonal spatial interpretation (e.g. front-back difference)

facilitates recording

Figure 6:
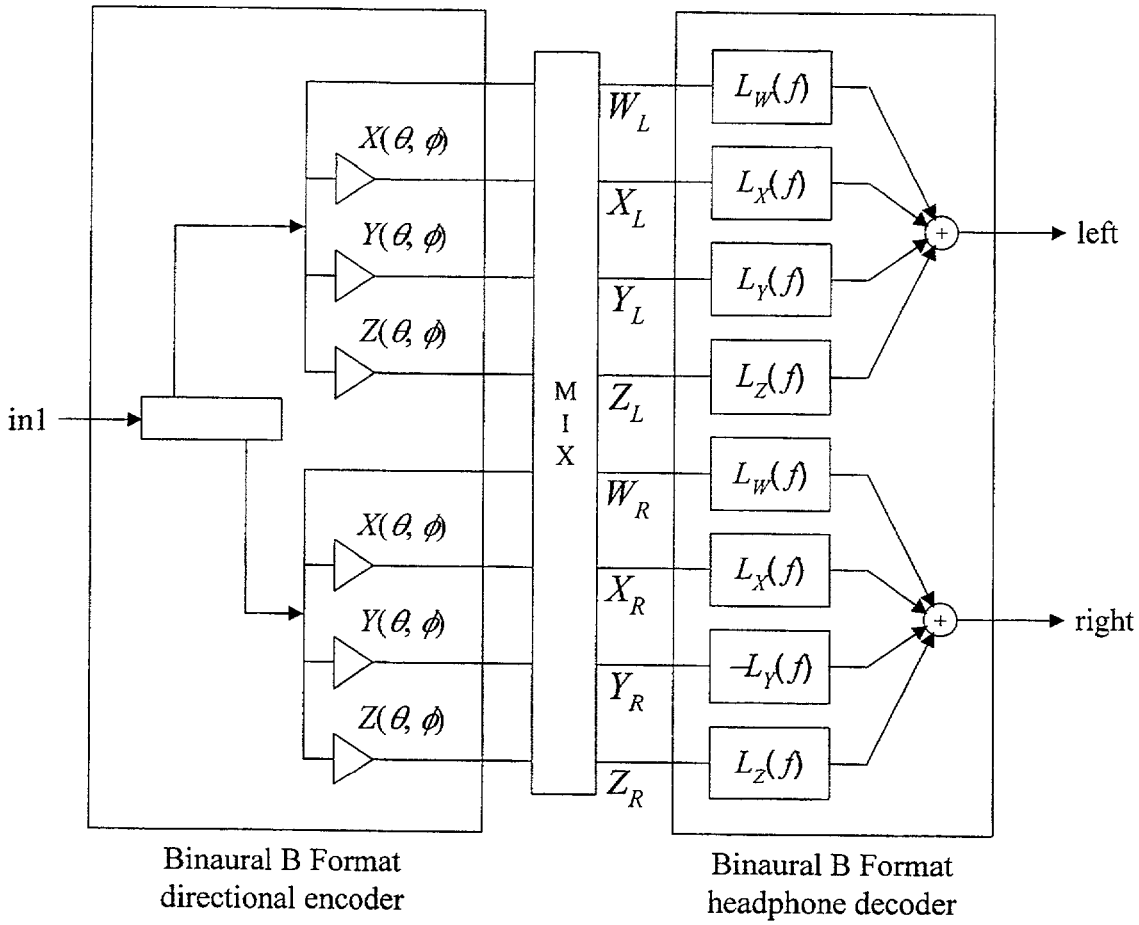
FIG. 6: Binaural B Format encoding with decoding for playback over over headphones.

FIG. 6 illustrates this method in the case where the minimum-phase HRTFs are decomposed over spherical harmonics limited to zero and first order. The directional encoding of the input signal produces an 8-channel encoded signal herein referred to as a "Binaural B Format" encoded signal. The mixer provides for mixing of additional source signals, including synthesized sources. Conversely, 8 filters are used to decode this format into a binaural output signal. The method can be extended to include any or all of the above higher-order spherical harmonics. Using the higher orders provides for more accurate reconstruction of HRTFs, especially at high frequencies (above 3 kHz).

As discussed above, a Soundfield microphone produces B format encoded signals. As such, a Soundfield microphone can be characterized by a set of spherical harmonic functions. Thus from FIG. 6, it can be seen that encoding a sound in accordance with the invention to produce Binaural B Format encoded signals, simulates a free-field recording using two Soundfield microphones located at the notional position of the two ears. This simulation is exact if the directional encoder provides ITD according to the following free-field model:

$$ITD(\sigma,\phi)=t_R(\sigma,\phi)-t_L(\sigma,\phi)=d/c\ \cos(\phi)\sin(\sigma),$$

where d is the distance between the microphones. If the ITD model provided in the encoder takes into account the diffraction of sound around the head or a sphere, the encoded signal and the recorded signal will differ in the value of the ITD for sounds away from the median plane. This difference can be reduced, in practice, by adjusting the distance between the two microphones to be slightly larger than the distance between the two ears of the listener.

The Binaural B Format recording technique is compatible with currently existing 8-channel digital recording technology. The recording can be decoded for reproduction over headphones through the bank of 8 filters $L_i(f)$ and $R_i(f)$ shown on FIG. 6, or decoded over two or more loudspeakers using methods to be described below. Before decoding, additional sources can be encoded in Binaural B Format and mixed into the recording.

The Binaural B Format offers the additional advantage that the set of four left or right channels can be used with conventional Ambisonic decoders for loudspeaker playback. Other advantages of using spherical harmonics as the spatial panning functions in carrying out the invention will be apparent in connection to multi-channel loudspeaker playback, offering an improved fidelity of 3-D audio reproduction compared to Ambisonic techniques.

Derivation of the Reconstruction Filters

For clarity, the derivation of the N reconstruction filters $L_i(f)$ will be illustrated in the case where the spatial panning functions $g_i(\sigma_p, \phi_p)$ are spherical harmonics. However, the methods described are general and apply regardless of the choice of spatial functions.

The problem is to find, for a given frequency (or time) f, a set of complex scalars $L_i(f)$ so that the linear combination of the spatial functions $g_i(\sigma_p, \phi_p)$ weighted by the $L_i(f)$ approximates the spatial variation of the HRTF $\underline{L}(\sigma_p, \phi_p, f)$ at that frequency (or time). This problem can be conveniently represented by the matrix equation $$\underline{L}=GL,$$

where

- the set of HRTF $\underline{L}(\sigma_p, \phi_p, f)$ defines the P×1 vector $\underline{L}$, P being the number of spatial directions
- each spatial panning function $g_i(\sigma_p, \phi_p)$ defines the P×1 vector $G_i$, and the matrix G is the P×N matrix whose columns are the vectors $G_i$
- the set of reconstruction filters $L_i(f)$ defines the N×1 vector of unknowns L.

The solution which minimizes the energy of the error is given by the pseudo inversion $$L=(G^TG)^{-1}G^T\underline{L},$$

where $(G^T G)$, known as the Gram matrix, is the N×N matrix formed by the dot products $G(i, k)=G_i^T G_k$ of the spatial vectors. The Gram matrix is diagonal if the spatial vectors are mutually orthogonal.

Simplest case: the sampled spatial functions are mutually orthogonal => filters are derived by orthogonal projection of the HRTF on the individual spatial functions (dot product computed at each frequency). Example: 2-D reproduction with regular azimuth sampling. If sampled functions are not mutually orthogonal, multiply by inverse of Gram matrix to ensure correct reconstruction.

Even when the panning functions $g_i(\sigma, \phi)$ are mutually ortogonal, as is the case with spherical harmonics, the vectors $G_i$ obtained by sampling these functions may not be orthogonal. This happens typically if the spatial sampling is not uniform (as is often the case with 3-D HRTF measurements). This problem can be remedied by redefining the spatial dot product so as to approximate the continuous integral of the product of two spatial functions $$\langle g_i, g_k\rangle=1/(4\pi)\int\sigma\int\sigma g_i(\sigma,\phi)g_k(\sigma,\phi)\cos(\phi)d\sigma d\phi$$

by $$\langle g_i, g_k\rangle=\Sigma_{\{p=1,\ldots P\}}g_i(\sigma_p,\phi_p)g_k(\sigma_p,\phi_p)dS(p)=G_i^T\Delta G_k$$

where Δ is a diagonal P×P matrix with Δ(p, p)=dS(p) and dS(p) is proportional to a notional solid angle covered by the HRTF measured for the direction $(\sigma_p, \phi_p)$. This definition yields the generalized pseudo inversion equation $$L=(G^T\Delta G)^{-1}G^T\Delta\underline{L},$$

where the diagonal matrix Δ can be used as a spatial weighting function in order to achieve a more accurate 3-D audio reproduction in certain regions of space compared to others, and the modified Gram matrix $(G^T \Delta G)$ ensures that the solution minimizes the mean squared error.

Additional possibility: project on a subset of the chosen set of spatial functions using above methods. Then project the residual error over other spatial functions (cf aes16). Example: to optimize fidelity of reconstruction in horizontal plane, project on W, X, Y first, and then project error on Z. Note that process can be iterated in more than 2 steps.

By combining the above techniques, it is possible, for a given set of spatial panning functions, to achieve control over chosen perceptual aspects of the 3-D audio reproduction, such as the front/back or up/down discrimination or the accuracy in particular regions of space.

Figure 7:
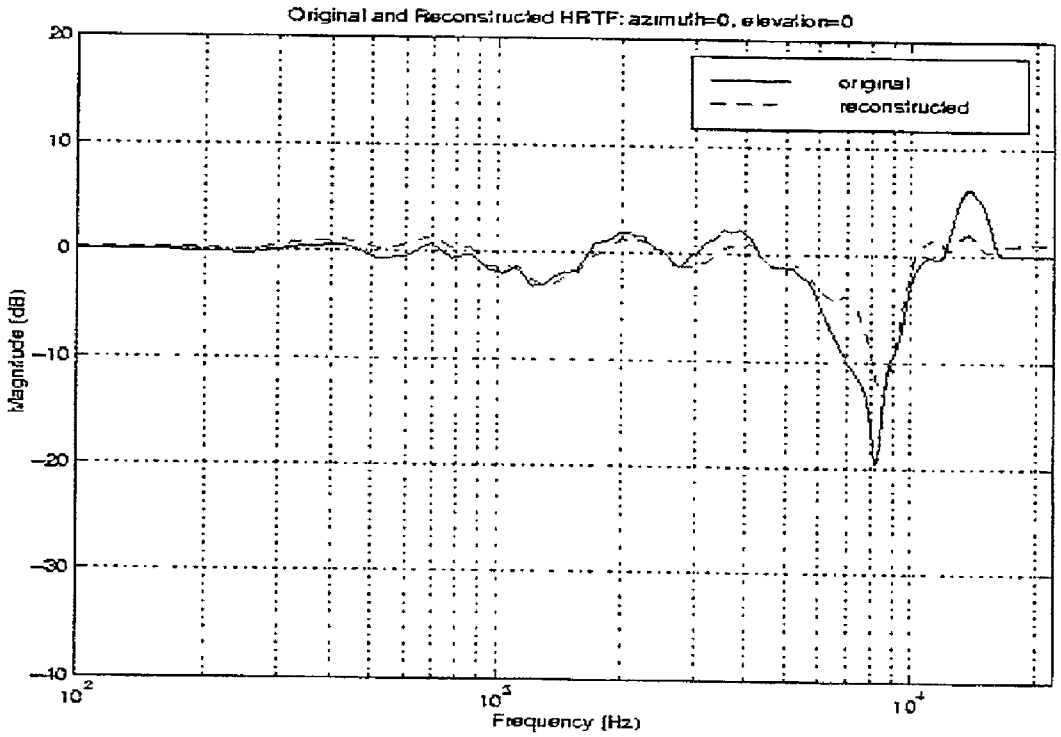
FIG. 7: Original and reconstructed HRTF with Binaural B Format (first-order reconstruction).
Figure 7:
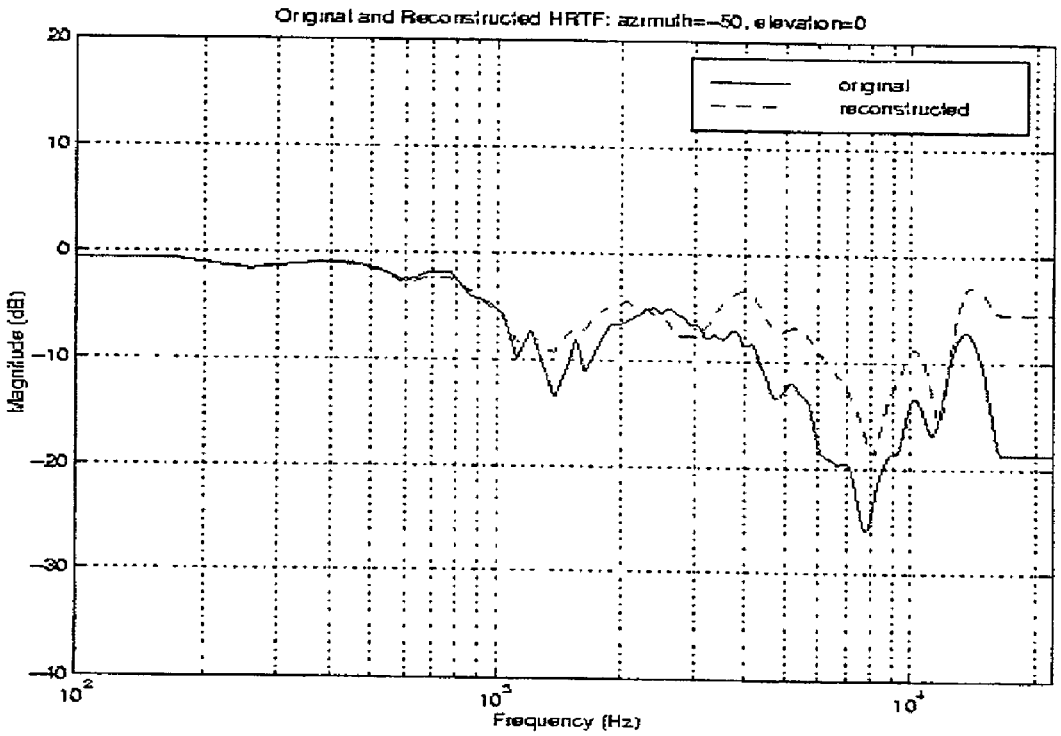
Figure 8:
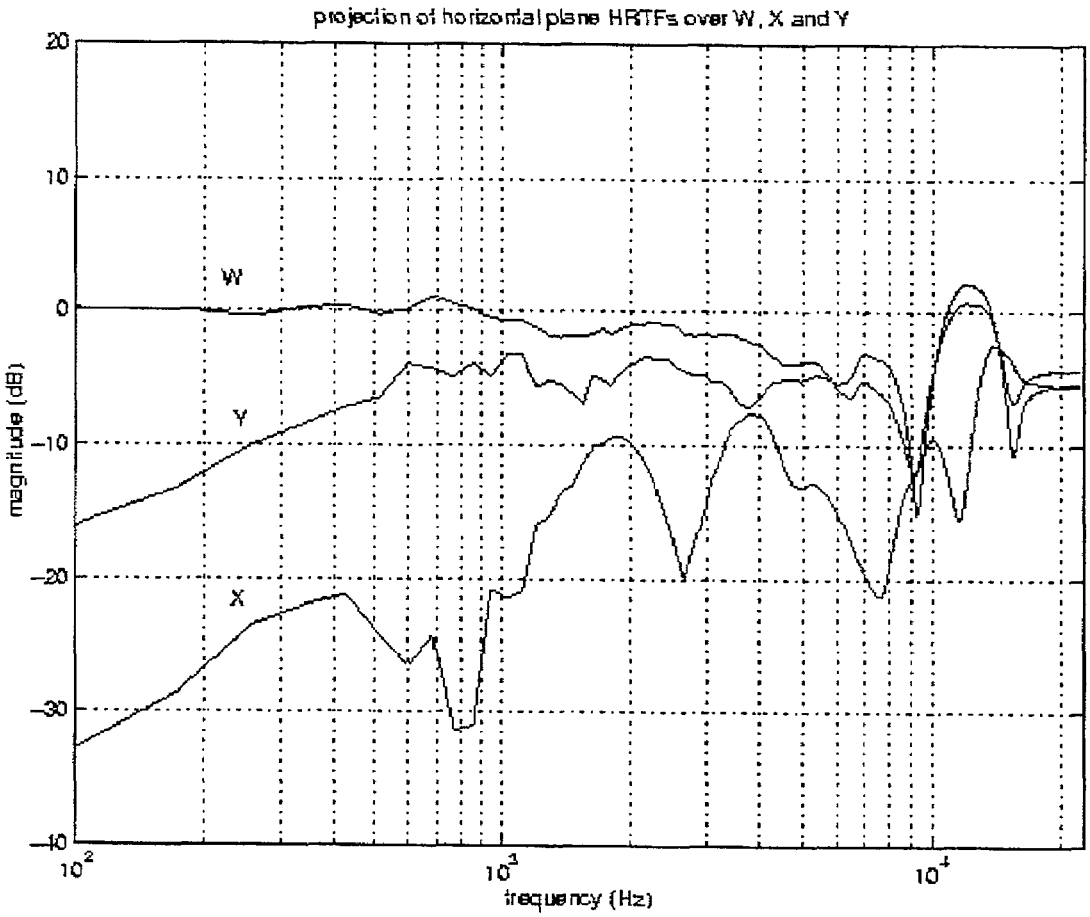
FIG. 8: Binaural B Format reconstruction filters (amplitude frequency response).

FIG. 7 illustrates the performance of the method for reconstructing the HRTF magnitude spectra in the horizontal plane (ϕ=0). For this reconstruction, only 3 channels per ear are necessary, since the Z channel is not used. The original data are diffuse-field equalized HRTFs derived from measurements on a dummy head. Due to the limitation to first-order harmonics, the reconstruction matches the original magnitude spectra reasonably well up to about 2 or 3 kHz, but the performance tends to degrade with increasing frequency. For large-scale applications, a gentle degradation at high frequencies can be acceptable, since inter-individual differences in HRTFs typically become prominent at frequencies above 5 kHz. The frequency responses of the reconstruction filters obtained in this case are shown on FIG. 8.

Adaptation of the Reconstruction Filters to the Listener

An advantage of a recording mad in accordance with the invention over a conventional two-channel dummy head recording is that, unlike prior art encoded signals, binaural B format encoded signals do not contain spectral HRTF features. These features are only introduced at the decoding stage by the reconstruction filters $L_i(f)$. Contrary to a conventional binaural recording, a Binaural B Format recording allows listener-specific adaptation at the reproduction stage, in order to reduce the occurrence of artifacts such as front-back reversals and in-head or elevated localization of frontal sound events.

Listener-specific adaptation can be achieved even more effectively in the context of a real-time digital mixing system. Moreover, the technique of the present invention readily lends itself to a real-time mixing approach and can be conveniently implemented as it only involves the correction of the head radius r for the synthesis of ITD cues and the adaptation of the four reconstruction filters $L_i(f)$. If diffuse-field equalization is applied to the headphones and to the measured HRTF, and therefore to the reconstruction filters $L_i(f)$, the adaptation only needs to address direction-dependent features related to the morphology of the listener, rather than variations in HRTF measurement apparatus and conditions.

Application of Discrete Panning Functions

Definition: functions which minimize the number of non-zero panning weights for any direction: 2 weights in 2D and 3 weights in 3D. For each panning function, there is a direction where this panning function reaches unity and is the only non-zero panning function. Example given in FIG. 1 for 2D case. Many variations possible.

An advantage of discrete panning functions: fewer operations needed in encoding module (multiplying by panning weight and adding into the mix is only necessary for the encoding channels which have non-zero weights).

The projection techniques described above can be used to derive the reconstruction filters. Alternatively, it can be noted that each discrete panning function covers a particular region of space, and admits a "principal direction" (the direction for which the panning weight reaches 1). Therefore, a suitable reconstruction filter can be the HRTF corresponding to that principal direction. This will guarantee exact reconstruction of the HRTF for that particular direction. Alternatively, a combination of the principal direction and the nearest directions can be used to derive the reconstruction filter. When it is desired to design a 3D audio display system which offers maximum fidelity for certain directions of the sound, it is straightforward to design a set of panning functions which will admit these specific directions as principal directions.

Methods for Playback Over Loudspeakers

Figure 3:
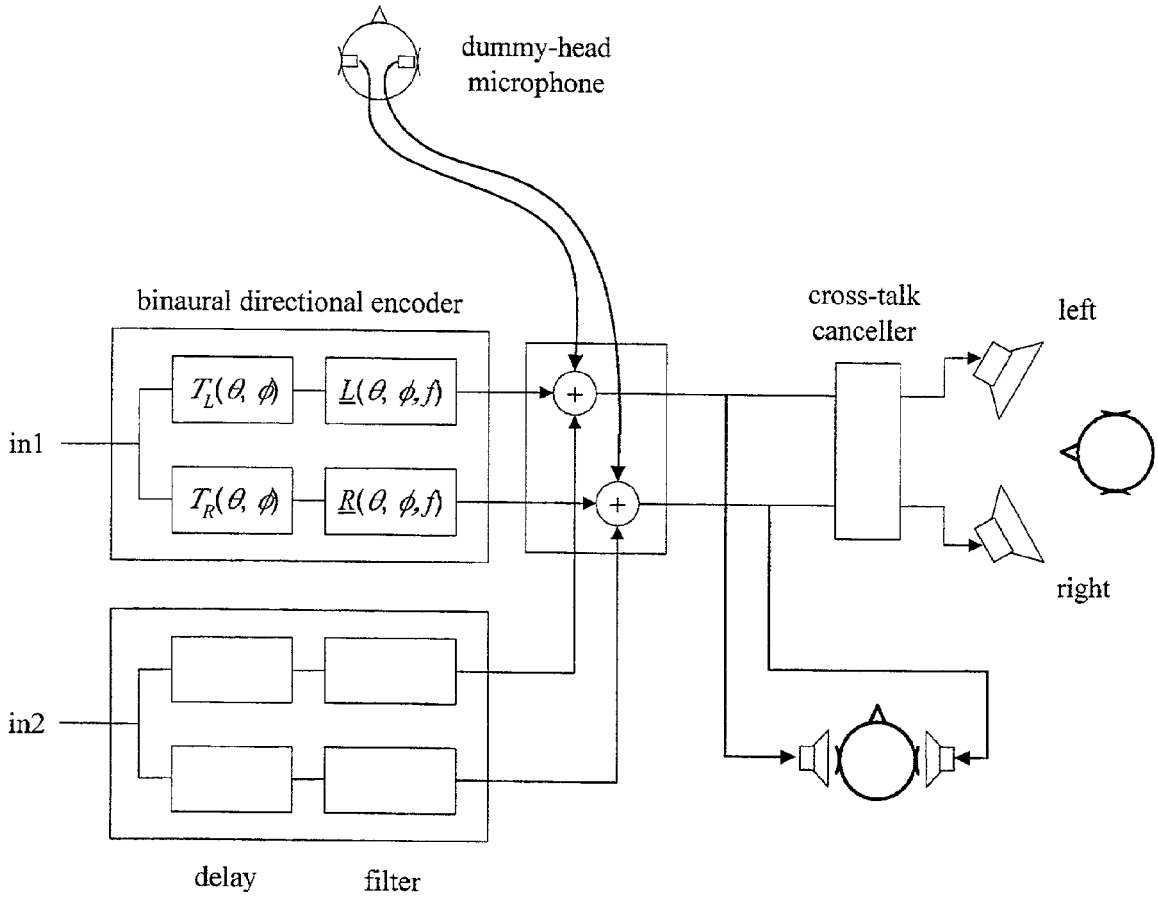
FIG. 3: Binaural encoding and recording. Playback over 2 speakers using cross-talk cancellation.

When used in the topologies of FIGS. 5*a* and 5*b*, the set of reconstruction filters obtained according to the present invention will provide a two-channel output signal suitable for high-fidelity 3D audio playback over headphones. As illustrated in FIG. 3, this two channel signal can be further processed through a cross-talk cancellation network in order to provide a two-channel signal suitable for playback over two loudspeakers placed in front of the listener. This technique can produce convincing lateral sound images over a frontal pair of loudspeakers, covering azimuths up to about ±120°. However, lateral sound images tend to collapse into the loudspeakers in response to rotations and translations of the listener's head. The technique is also less effective for sound events assigned to rear or elevated positions, even when the listener sits at the "sweet spot".

Figure 9:
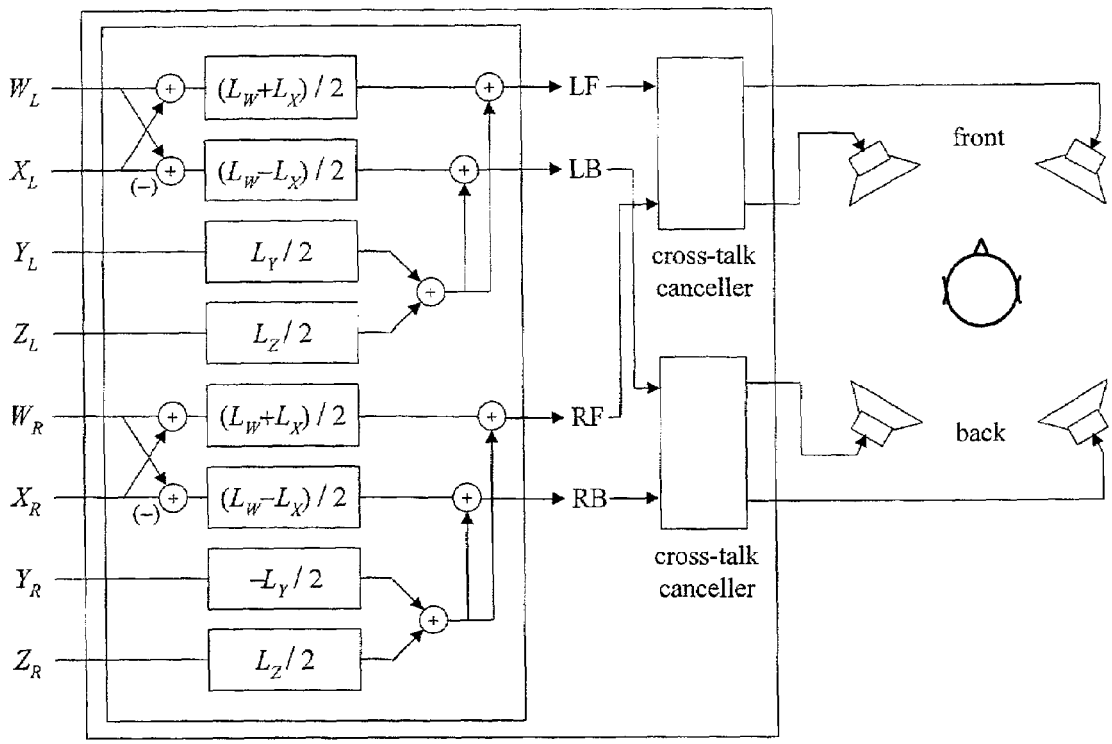
FIG. 9: Binaural B Format decoder for playback over 4 speakers.

FIG. 9 illustrates how, in the case of spherical harmonic panning functions, the reconstruction filters $L_i(f)$ can be utilized to provide improved reproduction over multi-channel loudspeaker playback systems. An advantage of the Binaural B Format is that it contains information for discriminating rear sounds from frontal sounds. This property can be exploited in order to overcome the limitations of 2-channel transaural reproduction, by decoding over a 4-channel loudspeaker setup. The 4-channel decoding network, shown in FIG. 9, makes use of the sum and difference of the W and X signals.

The binaural signal is decomposed as follows:

$$L(\sigma,\phi,f)=LF(\sigma,\phi,f)+LB(\sigma,\phi,f)$$

where LF and LB are the "front" and "back" binaural signals, defined by:

$$LF(\sigma,\phi,f)=0.5\{[W(\sigma,\phi)+X(\sigma,\phi)][L_W(f)+L_X(f)]+Y(\sigma,\phi)L_Y(f)+Z(\sigma,\phi)L_Z(f)\}$$

$$LB(\sigma,\phi,f)=0.5\{[W(\sigma,\phi)-X(\sigma,\phi)][L_W(f)-L_X(f)]+Y(\sigma,\phi)L_Y(f)+Z(\sigma,\phi)L_Z(f)\}$$

It can be verified that LB=0 for $(\sigma, \phi)=(0, 0)$ and that LF=0 for $(\sigma, \phi)=(\pi, 0)$. The network of FIG. 9 is designed to eliminate front-back confusions, by reproducing frontal sounds over the front loudspeakers and rear sounds over the rear loudspeakers, while elevated or lateral sounds are reproduced via both pairs of loudspeakers. This significantly improves the reproduction of lateral, rear or elevated sound images compared to a 2-channel loudspeaker setup (or to 4-channel loudspeaker reproduction using conventional pairwise amplitude panning or Ambisonic techniques). The listener is also allowed to move more freely than with 2-channel loudspeaker reproduction. By exploiting the Z component, a similar approach can be used to decode the binaural B format over a 3-D loudspeaker setup (comprising loudspeakers above or below the horizontal plane).

Figure 11:
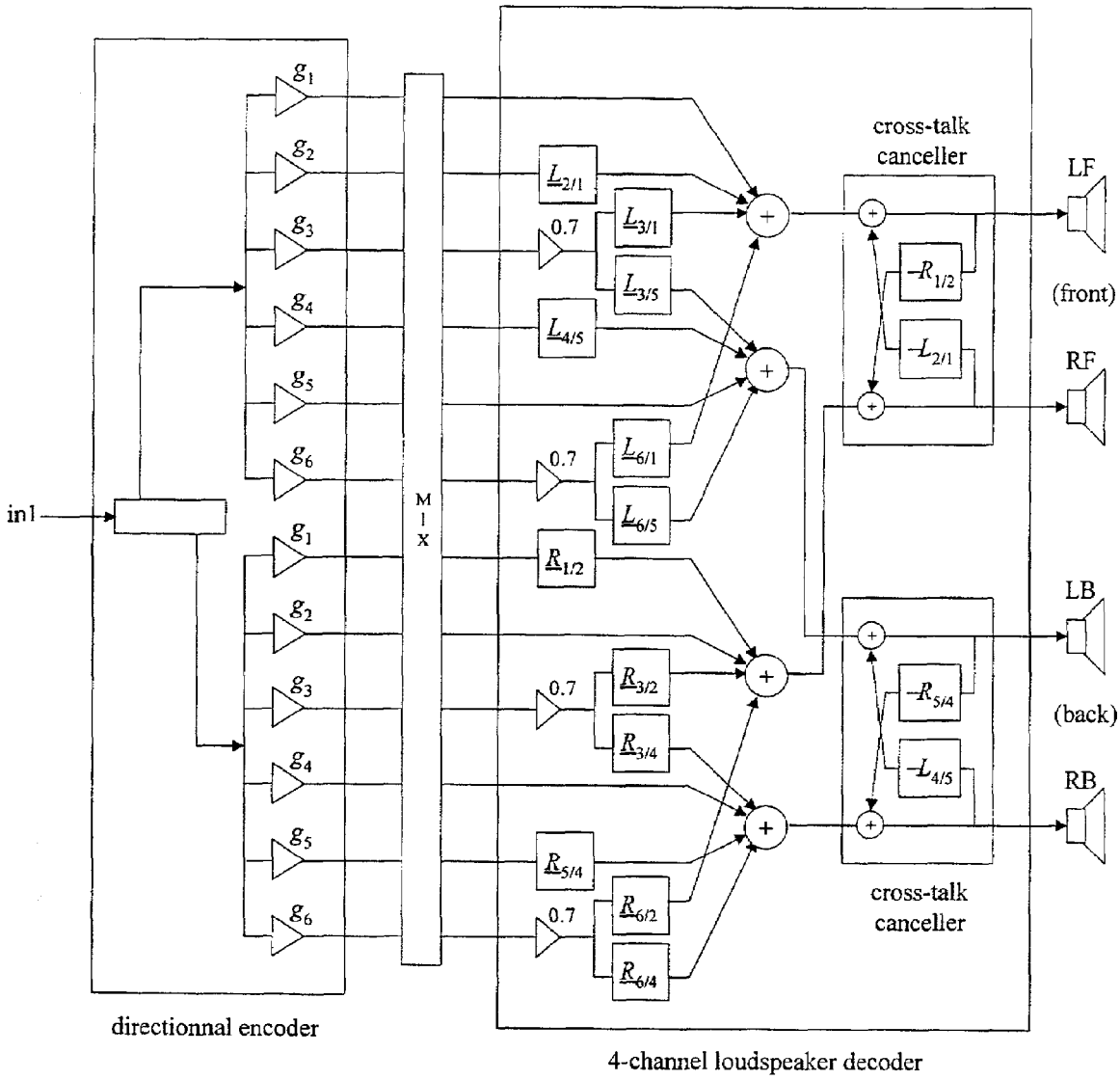
FIG. 11: Binaural Discrete Panning using 6 encoding channels, with decoder for playback over 4 speakers with cross-talk cancellation.

FIG. 11 illustrates how the present invention, applied with discrete panning functions, can be advantageously used to provide three-dimensional audio playback over two loudspeakers placed in front of the listener, with cross-talk cancellation. In this implementation of the invention, the discrete panning functions $g_i(\sigma, \phi)$ and $g_2(\sigma, \phi)$ are chosen so that their principal directions coincide, respectively, with the directions of the left and right loudspeakers from the listener's head (the principal direction of the discrete panning function $g_i(\sigma, \phi)$ is defined as $(\sigma_i, \phi_i)$ verifying $g_i(\sigma_i, \phi_i)=1.0$ and $g_j(\sigma_i, \phi_i)=0$ for $j\neq I$). Furthermore, the reconstruction filters and the cross-talk cancellation networks are free-field equalized, for each ear, with respect to the direction of the closest loudspeaker. As a result of these conditions, it can be verified that, if an audio signal is panned to the direction of one of the two loudspeakers, it is fed with no modification to that loudspeaker and cancelled out from the output feeding the other loudspeaker. Therefore, the resulting loudspeaker playback system combines, in conjunction with the previously described advantages of the present invention, the advantage of conventional discrete panning systems and the advantages of binaural reproduction techniques using cross-talk cancellation.

Figure 10:
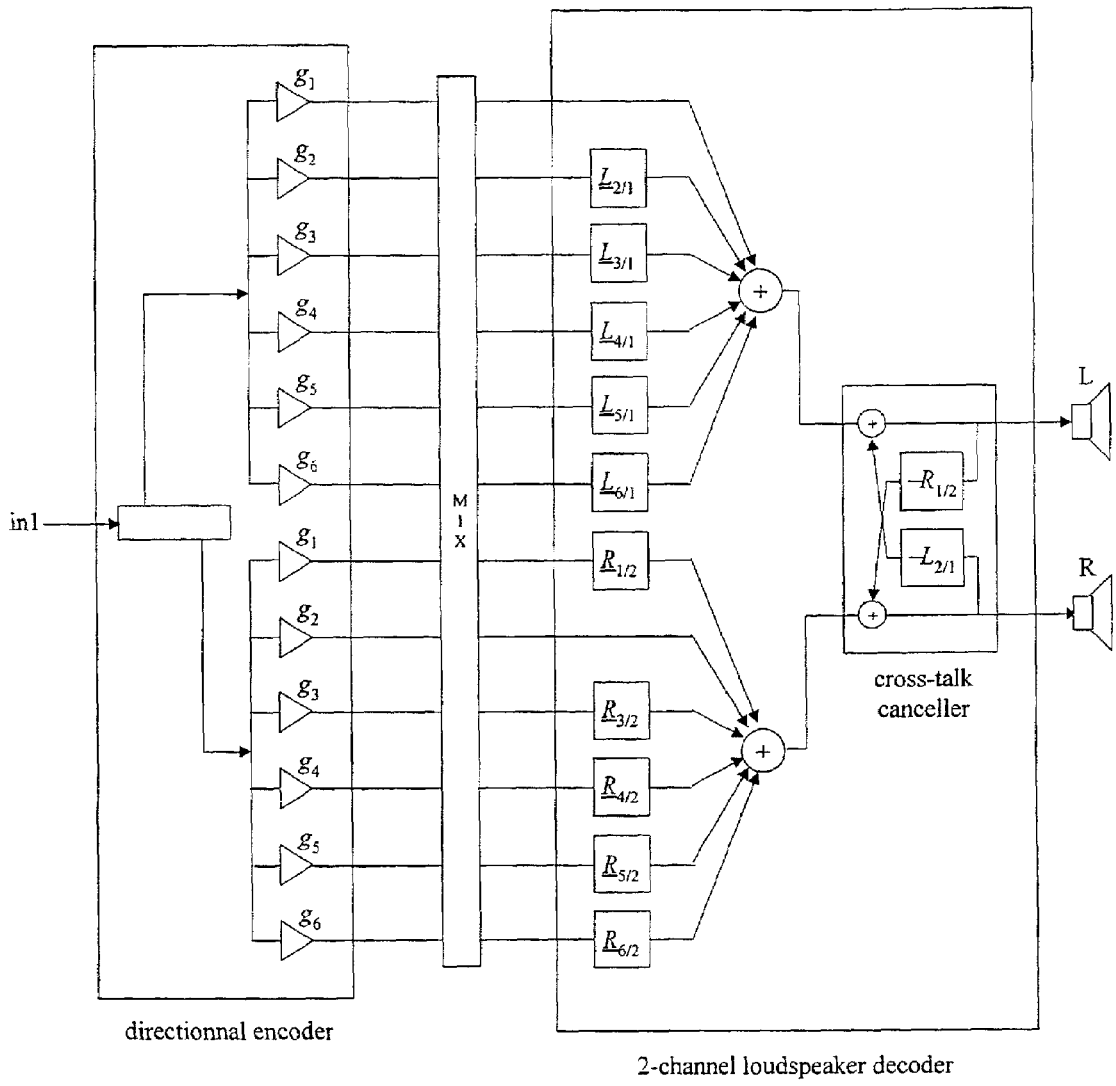
FIG. 10: Binaural Discrete Panning using 6 encoding channels, with decoder for playback over 2 speakers with cross-talk cancellation.

The following notations are used in FIG. 10 and FIG. 11:

$\underline{L}_{ij}$ denotes the ratio of two delay-free HRTFs:

$$\underline{L}_{ij}=\underline{L}(\sigma_i,\phi_i,f)/\underline{L}(\sigma_j,\phi_j,f);$$

$L_{ij}$ denotes the ratio of two delay-free HRTFs combined with the time difference between them:

$$L_{ij}=\exp(2\pi jf[t(\sigma_i,\phi_i)-t(\sigma_j,\phi_j)])\underline{L}(\sigma_i,\phi_i,f)/\underline{L}(\sigma_j,\phi_j,f).$$

FIG. 11 illustrates how the decoder of FIG. 10 can be modified to offer further improved three-dimensional audio reproduction over four loudspeakers arranged in a front pair and a rear pair. The method used is similar to the method used in the system of FIG. 9, in that a front cross-talk canceller and a rear cross-talk canceller are used, and they receive different combinations of the left and right encoded signals. These combinations are designed so that frontal sounds are reproduced over the front loudspeakers and rear sounds are reproduced over the rear loudspeakers, while elevated or lateral sounds are reproduced via both pairs of loudspeakers. FIG. 11 shows an embodiment of the present invention using 6 encoding channel for each ear, where channels 1 and 2 are front left and right channels, channels 5 and 4 are rear left and right channels, and channels 3 and 6 are lateral and/or elevated channels. A particular advantageous property of this embodiment is that, if an audio signal is panned towards the direction of one of the four loudspeakers (corresponding to the principal direction of one of the channels 1, 2, 4, or 5), it is fed with no modification to that loudspeaker and cancelled out from the output feeding the three other loudspeakers. It is noted that, generally, the systems of FIG. 10 or FIG. 11 can be extended to include larger numbers of encoding channels without departing from the principles characterizing the present invention, and that, among these encoding channels, one or more can have their principal direction outside of the horizontal plane so as to provide the reproduction of elevated sounds or of sounds located below the horizontal plane.

What is claimed is:

1. A method for positioning of a plurality of audio signals, the method including:

selecting a set of spatial functions, each having an associated scaling factor;

providing a first set of amplifiers and a second set of amplifiers, the gains of the amplifiers being functions of the scaling factors;

receiving a first audio signal of the plurality of audio signals;

providing a first direction representing the direction of the source of the first audio signal;

adjusting the gains of the first and the second set of amplifiers depending on the first direction;

applying the first set of amplifiers to the first audio signal to produce first encoded signals;

delaying the first audio signal to produce a first delayed audio signal; and applying the second set of amplifiers to the first delayed audio signal to produce second encoded signals;

providing a third set of amplifiers and a fourth set of amplifiers, the gains of the amplifiers being functions of the scaling factors;

receiving a second audio signal of the plurality of audio signals;

providing a second direction representing the direction of the source of the second audio signal;

adjusting the gains of the third and the fourth set of amplifiers depending on the second direction;

applying the third set of amplifiers to the second audio signal to produce third encoded signals;

delaying the second audio signal to produce a second delayed audio signal;

applying the fourth set of amplifiers to the second delayed audio signal to produce fourth encoded signals;

mixing the first and the third encoded signals or the first and the fourth encoded signals to provide a left-channel audio output;

mixing the second and the fourth encoded signals or the second and the third encoded signals to provide a right-channel audio output, the left-channel audio output excluding the second encoded signal and the right-channel audio output excluding the first encoded signal; and decoding the encoded signals using filters that are defined based on the spatial functions.

2. The method of claim 1 wherein the spatial functions are spherical harmonic functions.

3. The method of claim 2 wherein the spherical harmonic functions include at least the first-order harmonics.

4. The method of claim 1 wherein the spatial functions are discrete panning functions.

5. The method of claim 1 wherein for each of the first and second sets of amplifiers, the gain of each amplifier is based on a B-format encoding scheme.

6. The method of claim 1 wherein the second signal is a synthesized audio signal.

7. A method of producing an audio signal from directionally encoded multi-channel audio signals, the method including:

selecting a set of spatial functions;

generating a set of spectral functions based on the spatial functions;

receiving a first set of directionally encoded audio signals encoded according to the set of spatial functions, the first set of directionally encoded signals providing an encoded left-channel input;

receiving a second of set directionally encoded audio signals encoded according to the set of spatial functions, the second set of directionally encoded signals providing an encoded right-channel input, the encoded left-channel input excluding the second set of directionally encoded signals and the encoded right-channel input excluding the first set of directionally encoded signals;

providing a first set of decoding filters defined by the set of spectral functions;

providing a second set of decoding filters defined by the set of spectral functions;

applying the first set of decoding filters to the first set of directionally encoded audio signals to produce a first set of filtered signals;

applying the second set of decoding filters to the second set of directionally encoded audio signals to produce a second set of filtered signals; and providing the first set of filtered signals to a left-channel audio output and providing the second set of filtered signals to a right-channel audio output.

8. The method of claim 7 wherein the set of spatial functions is defined by $\{g_i(\theta, \phi), i=0, 1, \ldots N-1\}$ and generating the spectral functions includes providing $L_i(f)$ and $R_i(f)$ such that $\Sigma_{\{i=0, \ldots N-1\}} g_i(\theta_p, \phi_p) L_i(f)$ approximates $\underline{L}(\theta_p, \phi_p, f)$ and $\Sigma_{\{i=0, \ldots N-1\}} g_i(\theta_p, \phi_p) R_i(f)$ approximates $\underline{R}(\theta_p, \phi_p, f)$, where $\underline{L}(\theta_p, \phi_p, f)$ is a set of left-ear HRTFs and $\underline{R}(\theta_p, \phi_p, f)$ is a set of right-ear HRTFs, where $\{(\theta_p, \phi_p), p=1, 2, \ldots P\}$ is a set of directions and f is frequency.

9. The method of claim 8 wherein $\underline{L}(\theta_p, \phi_p, f)$ and $\underline{R}(\theta_p, \phi_p, f)$ are delay-free HRTFs.

10. The method of claim 8 wherein providing $L_i(f)$ includes solving, at each frequency f, the vector equation $\underline{L} \approx GL$, where:

the set of left-ear HRTFs $\underline{L}(\theta_p, \phi_p, f)$ define a P×1 vector $\underline{L}$, G is a P×N matrix whose columns are P×1 vectors $\underline{G}_i$, i=0, 1, . . . N−1 each of the N spatial functions $g_i(\theta_p, \phi_p, f)$ defines the vector $G_i$, and the set of $L_i(f)$ defines N×1 vector L.

11. The method of claim 10 wherein providing $L_i(f)$ is obtained by pseudo-inversion of the matrix G, resulting in $L=(G^TG)^{-1}G^T\underline{L}$.

12. The method of claim 11 wherein providing $L_i(f)$ includes projecting the P×1 vector $\underline{L}$ formed by the set of left-ear HRTFs $\underline{L}(\theta_p, \phi_p, f)$ over each of the P×1 vectors $G_i$ formed by the spatial functions $g_i(\theta_p, \phi_p, f)$ to compute the scalar product $L_i$.

13. The method according to claim 12 wherein an N×1 vector L formed by the scalar products $L_i$ is multiplied by the inverse of the Gram matrix $G^TG$.

14. The method of claim 10 wherein providing $L_i(f)$ is obtained by $L=(G^T\Delta G)^{-1}G^T\Delta\underline{L}$ where Δ is a diagonal P×P matrix where the P diagonal elements are weights applied to the individual directions $(\theta_p, \phi_p)$, p=1, 2, . . . P.

15. The method of claim 14 where each weight is proportional to a solid angle associated with the corresponding direction.

16. The method of claim 7 wherein the spatial functions are spherical harmonic functions.

17. The method of claim 16 wherein the spherical harmonic functions include at least zero- and first-order harmonics.

18. The method of claim 17 wherein the spectral functions define filters $L_W(f)$, $L_X(f)$, $L_Y(f)$, and $L_Z(f)$ effective for decoding binaural B-format encoded signals $W_L$, $X_L$, $Y_L$, $Z_L$, $W_R$, $X_R$, $Y_R$, $Z_R$, wherein the left-channel audio signal is defined by $W_L L_W(f)+X_L L_X(f)+Y_L L_Y(f)+Z_L L_Z(f)$ and the right-channel audio signal is defined by $W_R L_W(f)+X_R L_X(f)-Y_R L_Y(f)+Z_R L_Z(f)$; whereby left-and right-channel audio signals are suitable for playback with headphones.

19. The method of claim 17 wherein the spectral functions define filters $L_W(f)$, $L_X(f)$, $L_Y(f)$, and $L_Z(f)$ effective for decoding binaural B-format encoded signals $W_L$, $X_L$, $Y_L$, $Z_L$, $W_R$, $X_R$, $Y_R$, and $Z_R$; wherein the left-channel audio signal comprises two signals a first signal $LF=0.5\{[W_L+X_L][L_W(f)+L_X(f)]+Y_L L_Y(f)+Z_L L_Z(f)\}$ and a second signal $LB=0.5\{[W_L-X_L][L_W(f)-L_X(f)]+Y_L L_Y(f)+Z_L L_Z(f)\}$;

and wherein the right-channel audio signal comprises two signals a first signal $RF=0.5\{[W_R+X_R][L_W(f)+L_x(f)]+Y_R L_Y(f)+Z_R L_Z(f)\}$ and a second signal $RB=0.5\{[W_R-X_R][L_W(f)-L_X(f)]-Y_R L_Y(f)+Z_R L_Z(f)\}$;

whereby the left- and right-channel audio signals are suitable for playback over a pair of front speakers and a pair of rear speakers.

20. The method of claim 19 further including:

performing a first cross-talk cancellation on the LF and RF signals to feed the front speakers; and performing a second cross-talk cancellation on the LB and RB signals to feed the rear speakers.

21. The method according to claim 20 including cross-talk cancellation of the left and right audio signals before feeding the loudspeakers.

22. The method of claim 7 wherein the spatial functions are discrete panning functions having a direction, called a principal direction, where the spatial function is maximum and wherein all other spatial functions are zero.

23. The method of claim 22 wherein the spectral function associated with each spatial function is the delay-free HRTF for the corresponding principal direction.

24. The method according to claims 22 or 23 wherein one or more of the spatial functions have their principal direction corresponding to a direction of one of the loudspeakers.

25. The method according to claim 24 including performing cross-talk cancellation of the left and right audio signals before feeding the loudspeakers.

26. The method of claims 22 or 23 further including:

producing left-front and left-back signals based on the left-channel audio signal;

producing right-front and right-back signals based on the right-channel audio signal; and combining the left-front, left-back, right-front, and right-back signals to produce outputs suitable for playback with a pair of front speakers and a pair of rear speakers.

27. The method of claim 26 further including:

performing a first cross-talk cancellation on the left-front and right-front signals to feed the front speakers; and performing a second cross-talk cancellation on the left-back and right-back signals to feed the rear speakers.

28. The method of claim 27 wherein one or more of the spatial functions have their principal direction corresponding to the direction of a loudspeaker.

* * * * *

UNITED STATES PATENT AND TRADEMARK OFFICE

CERTIFICATE OF CORRECTION

PATENT NO. : 7,231,054 B1
APPLICATION NO. : 09/806193
DATED : June 12, 2007
INVENTOR(S) : Jot et al.

It is certified that error appears in the above-identified patent and that said Letters Patent is hereby corrected as shown below:

On sheet 11 of 13, in Fig. 9, delete “louspeaker” and insert -- loudspeaker --, therefor.

On sheet 12 of 13, in Fig. 10, delete “directionnal” and insert -- directional --, therefor.

On Sheet 13 of 13, in Fig. 11, delete “directionnal” and insert -- directional --, therefor.

Figure 2:
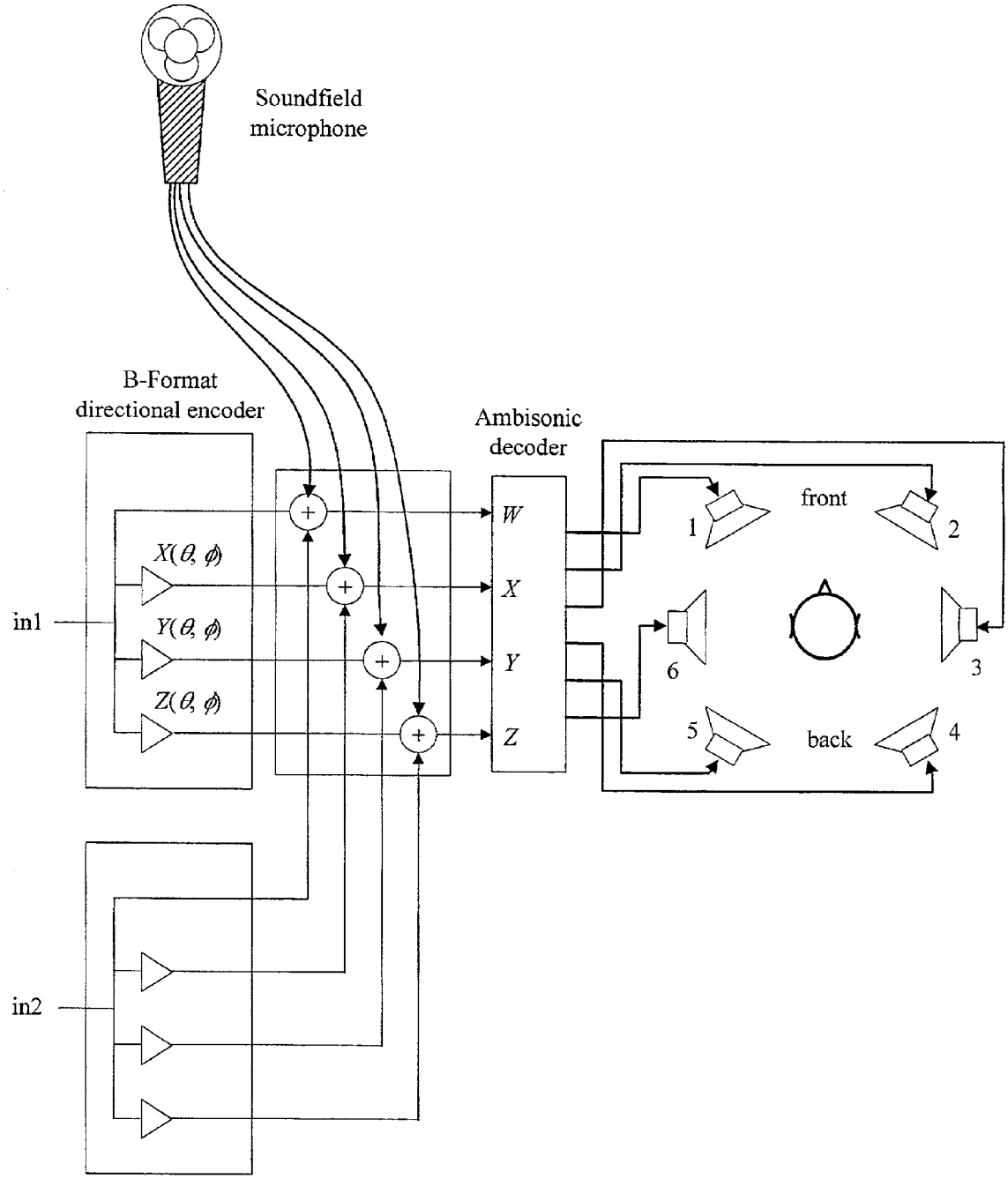
FIG. 2: B-format encoding and recording. Playback over 6 loudspeakers using Ambisonic decoding.

In column 1, lines 29–63, delete “An alternative approach, described in [Gerzon85], consists of producing a ‘B-Format’ multi-channel signal and reproducing this signal over loudspeakers via an ‘Ambisonic’ decoder, as illustrated in FIG. 2. Instead of discrete panning functions, the B Format uses real-valued spherical harmonics. The zero-order spherical harmonic function is named W, while the three first-order harmonics are denoted X, Y, and Z. These functions are defined as follows:

$W(\sigma,\phi)=1$ $X(\sigma,\Phi)=\cos(\phi)\cos(\sigma)$ $Y(\sigma,\Phi)=\cos(\phi)\sin(\sigma)$ $Z(\sigma,\Phi)=\sin(\phi)$ where $\sigma$ and $\phi$ denote respectively the azimuth and elevation angles of the sound source with respect to the listener, expressed in radians. An advantage of this technique over the discrete panning method is that B Format encoding does not require knowledge of the loudspeaker layout, which is taken into account in the design of the decoder. A second advantage is that a real-world B-Format recording can be produced with practical microphone technology, known as the ‘Soundfield Microphone’ [Farrah79]. As illustrated in FIG. 2, this allows for combining microphone-encoded sounds with electronically encoded sounds to produce a single B-format recording. First-order Ambisonic decoders do not reconstruct the acoustic pressure information at the ears of the listener except at low frequencies (below about 700 Hz). As described e.g. in [Bamford95], the frequency range can be extended by increasing the order of spherical harmonics, but only at the expense of a higher number of encoding channels and loudspeakers.” and insert the same on Col. 1, Line 30, below “mixing stage.” as a new paragraph.

UNITED STATES PATENT AND TRADEMARK OFFICE

CERTIFICATE OF CORRECTION

PATENT NO. : 7,231,054 B1
APPLICATION NO. : 09/806193
DATED : June 12, 2007
INVENTOR(S) : Jot et al.

It is certified that error appears in the above-identified patent and that said Letters Patent is hereby corrected as shown below:

In column 3, line 26, after "listener" insert -- , --.

In column 4, line 9, after "which" insert -- : --.

In column 4, line 22 (Approx.), after "playback" insert -- . --.

In column 4, line 32 (Approx.), delete "Discrete" and insert -- discrete --, therefor.

In column 4, line 38 (Approx.), after "playback" insert -- . --.

In column 4, line 54 (Approx.), after "playback over" delete "over". (Second occurrence)

In column 5, line 23 (Approx.), delete "$L(\sigma_p,\phi_p,f)=T_L(\sigma_p,\phi_p,f)L(\sigma_p,\phi_p,f)$," and insert -- $L(\sigma_p, \varphi_p, f) = T_L(\sigma_p, \varphi_p, f)\, L(\sigma_p, \varphi_p, f)$, --, therefor.

In column 7, line 10, delete "$H(f)=\exp(j\phi(f))H_{min}(f)$" and insert -- $H(f) = \exp(j\,\psi(f))\, H_{min}(f)$ --, therefor.

In column 7, line 12 (Approx.), delete "$\phi(f)$," and insert -- $\psi(f)$, --, therefor.

In column 7, line 14 (Approx.), delete "$\phi(f)$," and insert -- $\psi(f)$, --, therefor.

In column 7, line 17 (Approx.), delete "$\Phi_R$" and insert -- $\Psi_R$ --, therefor.

In column 7, line 17 (Approx.), delete "$\Phi_L$" and insert -- $\Psi_L$ --, therefor.

UNITED STATES PATENT AND TRADEMARK OFFICE

CERTIFICATE OF CORRECTION

PATENT NO. : 7,231,054 B1
APPLICATION NO. : 09/806193
DATED : June 12, 2007
INVENTOR(S) : Jot et al.

It is certified that error appears in the above-identified patent and that said Letters Patent is hereby corrected as shown below:

In column 7, lines 20–23 (Approx.), delete "The interaural time delay difference, ITD ($\sigma_p$, $\phi_p$), can be defined, for each direction ($\sigma_p$, $\phi_p$), by a linear approximation of the interaural excess-phase difference:
$\phi_R(\sigma,\phi,f)-\phi_L(\sigma,\phi,f)\approx 2\pi f ITD(\sigma,\phi)$" and insert the same on Col. 7, Line 21 (Approx.), below "$(\sigma_p, \phi_p, f)$." as a new paragraph.

In column 7, line 23 (Approx.), delete "$\phi_R(\sigma,\phi,f)-\phi_L(\sigma,\phi,f)\approx 2\pi f ITD(\sigma,\phi)$" and insert -- $\psi_R(\theta, \varphi, f) - \psi_L(\theta, \varphi, f) \cong 2\pi f ITD(\theta, \varphi)$ --, therefor.

In column 7, line 39 (Approx.), delete "$ITD(\sigma,\phi)\ 2r/c\ \cos(\phi)\sin(\sigma)$" and insert -- $ITD(\theta, \varphi) = 2r/c\ \cos(\varphi)\ \sin(\theta)$ --, therefor.

In column 7, line 57 (Approx.), delete "$\phi_R(\sigma, \phi, f)-\phi_L(\sigma, \phi, f)$" and insert -- $\psi_R(\theta, \varphi, f) - \psi_L(\theta, \varphi, f)$ --, therefor.

In column 7. line 58 (Approx.), delete "$\phi(\sigma, \phi, f)$" and insert -- $\psi(\theta, \varphi, f)$ --, therefor.

In column 7, line 59 (Approx.), delete "$\phi_R(\sigma,\phi,f)-\phi_L(\sigma,\phi,f)=\phi(\sigma,\phi,f)$" and insert -- $\psi_R(\theta, \varphi, f) - \psi_L(\theta, \varphi, f) \equiv \psi(\theta, \varphi, f)$ --, therefor.

In column 8, line 2 (Approx.), delete "$\phi_R(f)-\phi_L(f)=\phi_R(f)-\phi_L(f)-\phi(\sigma,\phi,f)$" and insert -- $\phi_R(f) - \phi_L(f) = \psi_R(f) - \psi_L(f) - \psi(\theta, \varphi, f)$ --, therefor.

In column 8, line 5 (Approx.), delete "$\sigma_p, f)$ and $R(\sigma_p, \sigma_p, f)$" and insert -- $\varphi_p, f)$ and $R(\theta_p, \varphi_p, f)$ --, therefor.

UNITED STATES PATENT AND TRADEMARK OFFICE

CERTIFICATE OF CORRECTION

PATENT NO. : 7,231,054 B1
APPLICATION NO. : 09/806193
DATED : June 12, 2007
INVENTOR(S) : Jot et al.

It is certified that error appears in the above-identified patent and that said Letters Patent is hereby corrected as shown below:

In column 8, line 30 (Approx.), after "recording" insert -- . --.

In column 9, line 55 (Approx.), delete "ortogonal," and insert -- orthogonal, --, therefor.

In column 9, line 64 (Approx.), delete " $<g_i,g_k>=1/(4\pi)\int\sigma\int\sigma g_i(\sigma,\phi)g_k(\sigma,\phi)\cos(\phi)d\sigma d\phi$ " and insert -- $< g_i, g_k > = 1/(4\pi) \int_\theta \int_\varphi g_i(\theta, \varphi) g_k(\theta, \varphi) \cos(\varphi) d\theta\, d\varphi$ --, therefor.

In column 12, line 21, delete " $g_z(\sigma, \phi)$ " and insert -- $g_i(\theta, \varphi)$ --, therefor.

In column 12, line 25, delete " $\sigma_z, \Phi_z$ " and insert -- $\theta_i, \varphi_i$ --, therefor.

In column 12, lines 25–26, delete " $\sigma_z, \Phi_z$ " and insert -- $\theta_i, \varphi_i$ --, therefor.

In column 12, line 40, delete "$\underline{L}_{i|j}$" and insert -- $\underline{L}_{i/j}$ --, therefor.

In column 12, line 41, delete " $L_{i|j}=L(\sigma_i,\Phi_i,f)/L(\sigma_j,\Phi_j,f);$ " and insert -- $L_{i/j} = L(\theta_i, \varphi_i, f) / L(\theta_j, \varphi_j, f);$ --, therefor.

In column 12, line 42 (Approx.), delete "$L_{i|j}$" and insert -- $L_{i/j}$ --, therefor.

In column 12, line 46 (Approx.), delete " $L_{i|j}=\exp(2\pi jf[t(\sigma_i,\Phi_i)-t(\sigma_j,\Phi_j)])L(\sigma_i,\Phi_i,f)/L(\sigma_j,\Phi_j,f).$ " and insert -- $L_{i/j} = \exp(2\pi j f[t(\theta_i, \varphi_i) - t(\theta_j, \varphi_j)]) L(\theta_i, \varphi_i, f) / L(\theta_j, \varphi_j, f).$ --, therefor.

In column 14, line 11, in Claim 7, delete "of set" and insert -- set of --, therefor.

In column 14, line 36, in Claim 8, delete " $g_i(\theta_p, \Phi_p)$ " and insert -- $g_i(\theta_p, \Phi_p)$ --, therefor.

UNITED STATES PATENT AND TRADEMARK OFFICE

CERTIFICATE OF CORRECTION

PATENT NO. : 7,231,054 B1
APPLICATION NO. : 09/806193
DATED : June 12, 2007
INVENTOR(S) : Jot et al.

It is certified that error appears in the above-identified patent and that said Letters Patent is hereby corrected as shown below:

In column 14, line 59, in Claim 12, delete " $g_i(\theta_p, \Phi_p, f)$ " and insert -- $g_i(\theta_p, \phi_p)$ --, therefor.

In column 14, line 65, in Claim 14, after "$\Delta \underline{L}$" insert -- , --.

In column 15, line 12, in Claim 18, after "$Y_R$," insert -- and --.

In column 15, line 15, in Claim 18, delete "left-and" and insert -- left- and --, therefor.

In column 16, line 3, in Claim 21, after "including" insert -- performing --.

In column 16, line 21 (Approx.), in Claim 26, delete "claims 22 or 23" and insert -- claim 22 --, therefor.

Signed and Sealed this

Twenty-second Day of December, 2009

David J. Kappos

David J. Kappos
*Director of the United States Patent and Trademark Office*